US008146514B2

(12) United States Patent
Hamilton et al.

(10) Patent No.: US 8,146,514 B2
(45) Date of Patent: Apr. 3, 2012

(54) TABLE CONSTRUCTION

(75) Inventors: John Hamilton, Grand Rapids, MI (US); Kurt Heidman, Grand Rapids, MI (US); Steven James Beukema, Ada, MI (US); Jay Grandin, Vancouver (CA)

(73) Assignee: Steelcase Inc., Grand Rapids, MI (US)

( * ) Notice: Subject to any disclaimer, the term of this patent is extended or adjusted under 35 U.S.C. 154(b) by 688 days.

(21) Appl. No.: 12/128,791

(22) Filed: May 29, 2008

(65) Prior Publication Data

US 2008/0295745 A1 Dec. 4, 2008

Related U.S. Application Data

(60) Provisional application No. 60/941,411, filed on Jun. 1, 2007.

(51) Int. Cl.
*A47B 37/00* (2006.01)

(52) U.S. Cl. ..... 108/50.02; 108/50.01; 312/223.6

(58) Field of Classification Search ..... 108/50.01, 108/50.02, 23, 153.1; 312/223.3, 223.6, 312/223.1, 195, 206, 257.1, 265.1, 265.2
See application file for complete search history.

(56) References Cited

U.S. PATENT DOCUMENTS

| | | | | |
|---|---|---|---|---|
| 631,750 | A | 8/1899 | Pleukharp | |
| 1,786,823 | A * | 12/1930 | Klinck et al. | 312/223.6 |
| 2,542,649 | A | 2/1951 | Flowers | |
| 3,228,736 | A * | 1/1966 | Beckerman | 312/223.6 |
| 3,883,202 | A | 5/1975 | Konig | |
| 4,224,769 | A | 9/1980 | Ball et al. | |
| 4,382,642 | A | 5/1983 | Burdick | |
| 4,562,986 | A | 1/1986 | Frascaroli et al. | |
| 4,600,173 | A | 7/1986 | Frascaroli et al. | |
| 4,639,049 | A | 1/1987 | Frascaroli et al. | |
| 4,679,510 | A | 7/1987 | Veyhl et al. | |
| 4,748,913 | A | 6/1988 | Favaretto et al. | |
| 4,798,423 | A | 1/1989 | LaCour | |
| 4,838,177 | A | 6/1989 | Vander Park | |
| 4,884,513 | A | 12/1989 | Newhouse et al. | |
| D308,444 | S | 6/1990 | Burdick | |

(Continued)

FOREIGN PATENT DOCUMENTS

DE 299 22 976 U1 3/2000

(Continued)

OTHER PUBLICATIONS

Sedus, "Sedus Invitation," (28 Pages), (May 12, 2005).

(Continued)

*Primary Examiner* — Jose V Chen
(74) *Attorney, Agent, or Firm* — Price Heneveld LLP

(57) ABSTRACT

A table has two end legs arranged in a parallel, laterally spaced apart relationship for support on a floor surface. Two side rails are arranged in a parallel, laterally spaced apart relationship, and are connected with upper portions of the end legs to retain them in an upright orientation, defining a self-supported table frame without intermediate bracing between the side rails, with a central, vertically extending widow. Top support members are connected with the side rails and protrude outwardly therefrom in a cantilevered fashion. A top member is supported on and connected with the table frame and the top support members, defining a plurality of workstations. A utility module configured to route utilities is positioned within the window of the frame, with opposite sides abuttingly supported on the side rails to removably mount the utility module on the frame and thereby accommodate different utility requirements at the workstations.

37 Claims, 28 Drawing Sheets

U.S. PATENT DOCUMENTS

| | | | | | |
|---|---|---|---|---|---|
| 4,944,235 | A | | 7/1990 | Jahnke et al. | |
| 4,974,913 | A | | 12/1990 | Vogt et al. | |
| 5,078,055 | A | | 1/1992 | Bellini et al. | |
| 5,130,494 | A | | 7/1992 | Simonton et al. | |
| 5,154,126 | A | | 10/1992 | Newhouse et al. | |
| 5,174,532 | A | | 12/1992 | Huang | |
| 5,186,425 | A | | 2/1993 | Keusch et al. | |
| 5,241,914 | A | | 9/1993 | Korb | |
| 5,277,132 | A | | 1/1994 | Korb | |
| 5,289,784 | A | | 3/1994 | Waibel | |
| 5,522,324 | A | | 6/1996 | Van Gelder et al. | |
| 5,544,593 | A | | 8/1996 | Canfield et al. | |
| 5,568,773 | A | * | 10/1996 | Hung | 108/50.02 |
| 5,598,790 | A | | 2/1997 | Fich | |
| 5,609,402 | A | | 3/1997 | Kemp | |
| D379,887 | S | | 6/1997 | Muller-Deisig et al. | |
| 5,638,759 | A | | 6/1997 | Klugkist | |
| 5,666,888 | A | | 9/1997 | Dame et al. | |
| 5,715,761 | A | | 2/1998 | Frattini | |
| 5,746,488 | A | | 5/1998 | LaCour | |
| 5,833,332 | A | | 11/1998 | Marshall et al. | |
| D403,898 | S | | 1/1999 | Arnegger | |
| 5,921,052 | A | | 7/1999 | Kemp | |
| 5,954,409 | A | | 9/1999 | LaCour | |
| 5,975,657 | A | | 11/1999 | LaCour | |
| 6,003,447 | A | * | 12/1999 | Cox et al. | 108/50.02 |
| 6,024,024 | A | | 2/2000 | Favaretto | |
| 6,050,659 | A | | 4/2000 | LaCour | |
| 6,076,903 | A | | 6/2000 | Vander Park | |
| 6,086,028 | A | | 7/2000 | Pfister | |
| 6,146,046 | A | | 11/2000 | Oberle | |
| 6,152,048 | A | | 11/2000 | Vander Park | |
| 6,180,884 | B1 | | 1/2001 | Tokunaga et al. | |
| 6,202,567 | B1 | | 3/2001 | Funk et al. | |
| 6,267,064 | B1 | | 7/2001 | Ostertag et al. | |
| 6,283,043 | B1 | | 9/2001 | Stern et al. | |
| 6,293,506 | B1 | | 9/2001 | Gutgsell et al. | |
| 6,302,035 | B1 | | 10/2001 | Frenkler et al. | |
| 6,327,983 | B1 | | 12/2001 | Cronk et al. | |
| 6,347,592 | B1 | | 2/2002 | Gessert | |
| 6,389,988 | B1 | | 5/2002 | Frattini | |
| D460,639 | S | | 7/2002 | Crinion | |
| 6,415,723 | B1 | | 7/2002 | Kopish et al. | |
| 6,435,106 | B2 | | 8/2002 | Funk et al. | |
| 6,481,169 | B1 | | 11/2002 | Ludwig et al. | |
| 6,490,981 | B2 | | 12/2002 | Isensee et al. | |
| 6,523,795 | B2 | | 2/2003 | Gutgsell et al. | |
| D474,049 | S | | 5/2003 | Wakasugi et al. | |
| 6,588,346 | B1 | | 7/2003 | Bockheim et al. | |
| 6,629,505 | B1 | | 10/2003 | Cronk et al. | |
| 6,647,900 | B1 | | 11/2003 | Kopish | |
| 6,725,784 | B2 | | 4/2004 | Crinion | |
| 6,729,244 | B2 | | 5/2004 | Cattaneo | |
| 6,732,660 | B2 | | 5/2004 | Dame et al. | |
| 6,766,748 | B2 | | 7/2004 | Insalaco et al. | |
| 6,786,161 | B2 | | 9/2004 | Fischer | |
| D504,253 | S | | 4/2005 | Bouroullec et al. | |
| 6,895,868 | B1 | | 5/2005 | Cronk et al. | |
| D506,888 | S | | 7/2005 | Althofer | |
| 6,986,556 | B2 | | 1/2006 | Haberman | |
| 6,990,909 | B2 | * | 1/2006 | Gosling et al. | 108/50.02 |
| 7,036,438 | B2 | | 5/2006 | Okamoto et al. | |
| 7,066,097 | B2 | | 6/2006 | Gayhart et al. | |
| 7,111,564 | B2 | | 9/2006 | Chang | |
| 7,191,713 | B2 | | 3/2007 | Gayhart et al. | |
| 7,343,864 | B2 | * | 3/2008 | Canin et al. | 108/50.02 |
| 7,703,398 | B2 | * | 4/2010 | Brauning et al. | 108/50.02 |
| 7,765,937 | B2 | * | 8/2010 | Weissenrieder et al. | 108/50.02 |
| 7,871,280 | B2 | * | 1/2011 | Henriott | 108/50.02 |
| 2003/0010260 | A1 | | 1/2003 | Chang | |
| 2003/0226478 | A1 | | 12/2003 | Nicoletti | |
| 2005/0263041 | A1 | | 12/2005 | Mueller et al. | |
| 2005/0268823 | A1 | | 12/2005 | Bakker et al. | |
| 2005/0284341 | A1 | | 12/2005 | Klassy et al. | |
| 2006/0096506 | A1 | | 5/2006 | Brauning et al. | |
| 2006/0162626 | A1 | | 7/2006 | Brauning et al. | |
| 2007/0251428 | A1 | * | 11/2007 | Mead et al. | 108/50.02 |
| 2008/0295745 | A1 | * | 12/2008 | Hamilton et al. | 108/50.02 |
| 2009/0165680 | A1 | * | 7/2009 | Bakker et al. | 108/50.02 |
| 2009/0273260 | A1 | * | 11/2009 | Kemp | 108/50.02 |

FOREIGN PATENT DOCUMENTS

| | | | |
|---|---|---|---|
| DE | 100 08 179 | A1 | 1/2002 |
| EP | 1 008 315 | A1 | 6/2000 |
| WO | WO 98/07350 | | 2/1998 |

OTHER PUBLICATIONS

Ahrend, "Ahrend 1200," (9 Pages), (publication date unkown).

* cited by examiner

TABLE CONSTRUCTION

CROSS-REFERENCE TO RELATED APPLICATION

This application claims the benefit of U.S. Provisional Application No. 60/941,411, filed Jun. 1, 2007, entitled TABLE CONSTRUCTION, which is hereby incorporated herein by reference in its entirety.

BACKGROUND OF THE INVENTION

The present invention relates to furnishings for open office spaces and other similar environments, and in particular to a table construction therefor.

Elongate tables and worksurfaces, such as those used for conference tables, library tables, trader desks, and the like are generally well known in the art. More recently, such tables have been equipped with selected utilities, such as power and data, to support computers, telephones, video equipment and other similar electronic devices that are used on the table. Preferably, power and data ports or connections are positioned along the table for easy user access when working with a computer or like electronic device. While such prior tables have been generally effective, they are not particularly adaptable, and can not be readily reconfigured or expanded to meet different needs and/or users.

Changing technology and changing work processes demand that current office furnishings be readily adaptable to efficiently support the ever-changing needs of workers. Therefore, the quick and easy reconfigurability of a worksurface system is desired to meet these needs. A more recent challenge for such office furnishing is created by the increased use of hotelling, wherein many mobile staffers do not have a permanently assigned office, but rather reserve shared space at the various locations in which they work. These transient workers require even more adaptability in their shared work space to effectively perform tasks in an efficient manner. Hence, office furnishings capable of supporting multiple transient workers in a cost effective manner with minimum floor space are very beneficial, particularly when they can be readily adapted and reconfigured to provide important utilities at each of the various workstations.

SUMMARY OF THE INVENTION

One aspect of the present invention is a table for offices and the like having first and second leg members in a generally parallel, lateral, spaced apart relationship and configured to be supported on a floor surface in a generally upright orientation. First and second side rail members are disposed in a generally parallel, lateral, spaced apart relationship and have opposite end portions thereof connected to the upper portions of the first and second leg members to rigidly retain the first and second leg members in a generally upright orientation and define a table frame. The table frame is rigid and self-supported without intermediate bracing between the first and second side rail members, thus creating a central, vertically extending window disposed between the side rails. A plurality of top support members are connected to the first and second side rail members and protrude outwardly therefrom in a cantilevered fashion. A top member defining a plurality of work stations along the table is supported by the top support members and the table frame. A utility module member is configured to facilitate route utilities to different work stations and positioned within the window of the table frame and is abuttingly supported by the first and second side rail members to removably mount the utility module member on the table frame and thereby accommodate a variety of different utility requirements at the different work stations.

Another aspect of the present invention is a table for offices and the like having first and second end leg members disposed in a laterally spaced apart relationship and configured to be supported on a floor surface. First and second side rail members are disposed in a laterally spaced apart relationship and have opposite end portions connected to the first and second end leg members to define a table frame. The first and second side rail members include inwardly protruding ledges extending along inside portions of the side rail members. A top member is supported on and connected to the table frame. A trough member is positioned generally centrally along the top member and includes opposite sides which are abuttingly supported on the inwardly protruding ledges of the first and second side rail members to removably support the trough member on the table to accommodate different users.

Yet another aspect of the present invention is a table for offices and the like having first and second end leg members disposed in a laterally spaced apart relationship and configured to be supported on a floor surface. First and second side rail members are disposed in a laterally spaced apart relationship and have opposite end portions connected with the first and second end leg members to define a table frame. The first and second side rail members include an inwardly protruding ledge extending along the inside portion of the side rail members. A top member is supported on and connected with the table frame. A trough member is positioned generally centrally along the top member and includes opposite sides thereof abuttingly supported on the inwardly protruding ledges of the first and second side rail members. The trough member includes at least one upwardly opening channel which is configured to detachably mount a variety of accessories therein to personalize the work areas along said top member.

Yet another aspect of the present invention is a table having first and second end leg members disposed in a laterally spaced apart relationship, and first and second side rail members disposed in a laterally spaced apart relationship with end portions connected to the first and second end leg members to define a rigid table frame for supporting a top member. A modular leg assembly defining at least one of the first and second leg members includes an upper portion and a lower portion configured for abutting support on a floor surface. An end rail member has opposite ends operably connected to the first and second leg members to retain the leg members in a lateral spaced apart relationship. First and second top support arms include outer portions configured to support the top member and inner portions having three way connector blocks with first connectors extending generally downward and detachably connected to the upper portions of the first and second leg members, second connectors extending generally inward and detachably connected to the opposite ends of the first and second side rail members, and third connectors extending generally laterally at a predetermined angle to the first and second connectors and detachably connected with the opposite ends of the end rail.

Yet another aspect of the present invention is a table for offices and the like having first and second end leg members disposed in a laterally spaced apart relationship and configured to be supported on a floor surface. First and second side rail members are disposed in a laterally spaced apart relationship and include opposite end portions connected to the first and second end leg members to define a table frame. The first and second side rail members include an outwardly opening channel extending along the top portion of the side rail members. A top member is supported on the table and includes an inwardly protruding tab disposed along an interior edge of the top member, which is closely received in the outwardly opening channel of the side rail to removably connect at least a portion of the top member with the table frame.

Yet another aspect of the present invention is an elongate table having side rails that engage a utility trough that can be easily removed and is adapted to support any number of accessories to customize a plurality of workstations spaced along the table. The utility trough is rigidly secured in the table frame, yet is easily removed for the customization of the workstations. The utility trough is also adapted to supply power, data and the like to the different workstations while maintaining a seamless, continuous and aesthetically pleasing worksurface.

These and other features, advantages and object of the present invention will be further understood and appreciated by those skilled in the art upon studying the following specification, claims, and appended drawings.

BRIEF DESCRIPTION OF THE DRAWINGS

FIGS. 19A-20 are fragmentary exploded perspective views of the end leg, including corner covers, fasteners and spacers.

DETAILED DESCRIPTION OF THE PREFERRED EMBODIMENTS

Figure 1:
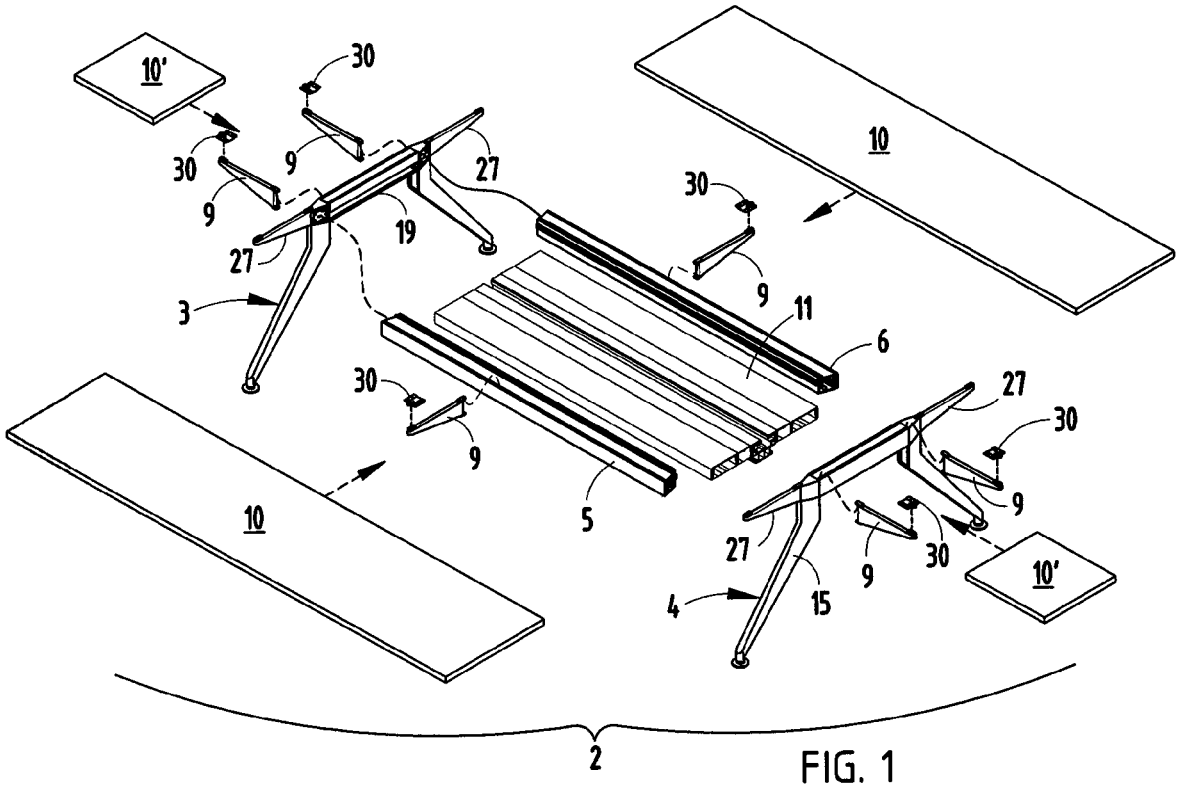
FIG. 1 is an exploded perspective view of a table embodying the present invention.

For the purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in following specification, are simply exemplary embodiments. Hence, specific dimensions and other physical characteristics relating to the embodiments disclosed herein are not to be construed as limiting, unless expressly stated otherwise.

Figure 36:
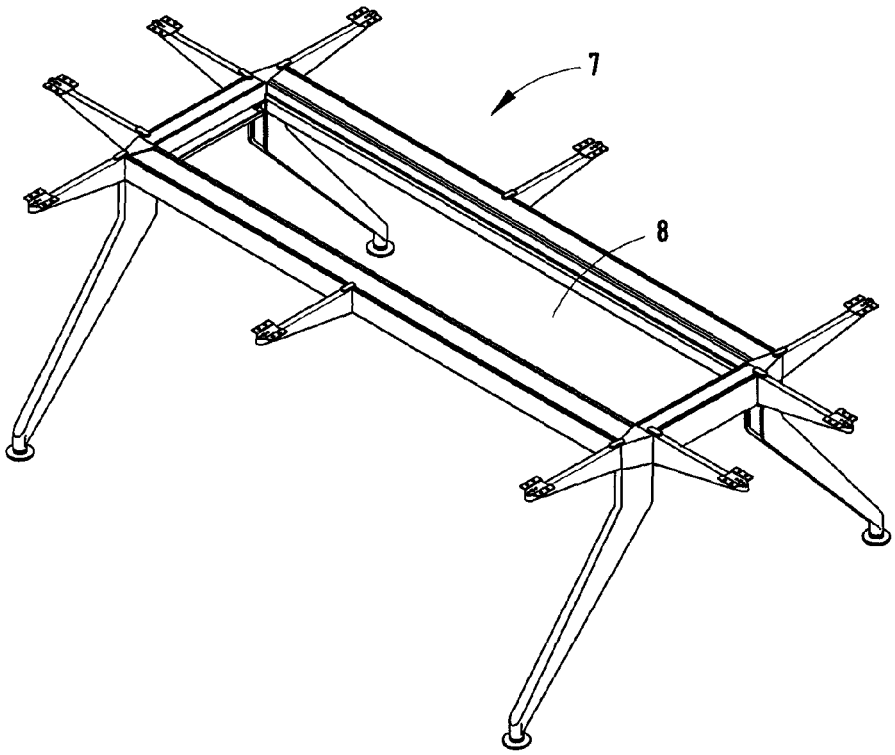
FIG. 36 is a perspective view of the table frame.

The reference numeral 2 (FIGS. 1 and 2) generally designates a table for offices and the like which includes first and second end leg members 3 and 4 disposed in a generally parallel, laterally spaced apart relationship. The first and second end leg members 3 and 4 are configured to be abuttingly supported on a floor surface in a generally upright orientation. First and second side rail members 5 and 6 are disposed in a generally parallel, laterally spaced apart relationship and are connected to upper portions of the first and second end leg members 3 and 4 to rigidly retain first and second end leg members 3 and 4 in a generally upright orientation, and thereby define a rigid, self supported table frame 7 without intermediate bracing between first and second side rail members 5 and 6, with a central, vertically extending window 8 (FIGS. 36 and 37) disposed between side rail members 5 and 6. A plurality of top support members 9 are operably connected with the first and second side rail members 5 and 6 and protrude outwardly therefrom in a cantilevered fashion. A top member 10 is supported on and operably connected with the table frame 7 and the top support members 9 to define a plurality of workstations 10*a*-10*c*, along the table 2. A utility module member 11 is configured to facilitate routing utilities to the different workstations 10*a*-10*c* of table 2, and is positioned within the window 8 of table frame 7. The utility module member 11 has opposite sides abuttingly supported on first and second side rail members 5 and 6 to removably mount the utility module 11 on the frame 7, and thereby accommodate a variety of different utility requirements at the workstations 10*a*-10*c*. One such exemplary model can found in U.S. patent application Ser. No. 29/288,192, filed Jun. 1, 2007 entitled TWIN BEAM TABLE DESIGN which is hereby incorporated by reference in its entirety.

Figure 37:
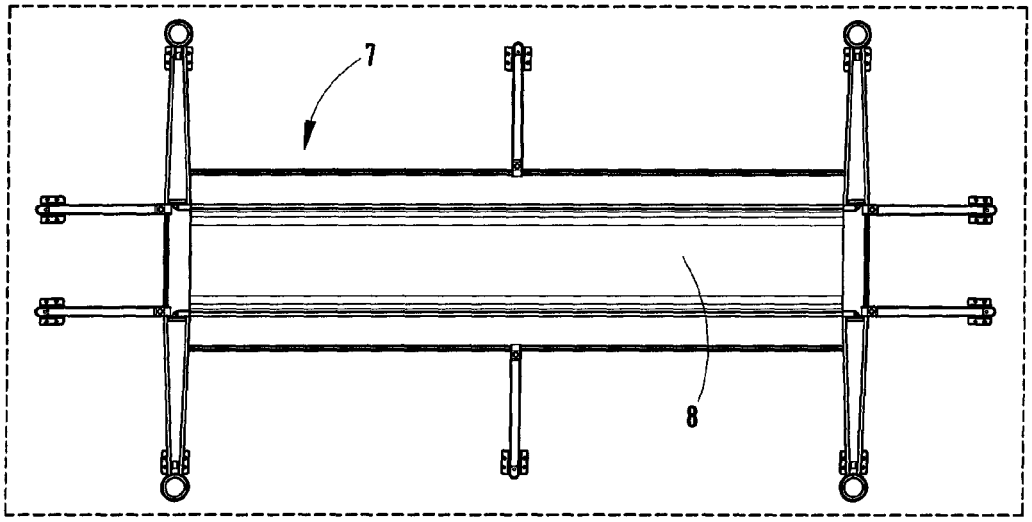
FIG. 37 is a bottom plan view of the table frame.

In one embodiment of the present invention, the window 8 of the table frame 7 has an elongate plan configuration as in the example illustrated in FIG. 37. The utility module member 11 is disposed in the window 8 and can support a wide variety of accessories at different locations on table 2 to customize the workstations 10*a*-10*c*. In the example illustrated in FIG. 2, table 2 includes a shelf accessory 13 detachably mounted in the utility module member 11. The table 2 shown in FIG. 2 also includes a task light 14 detachably mounted in the utility module member 11.

Figure 24:
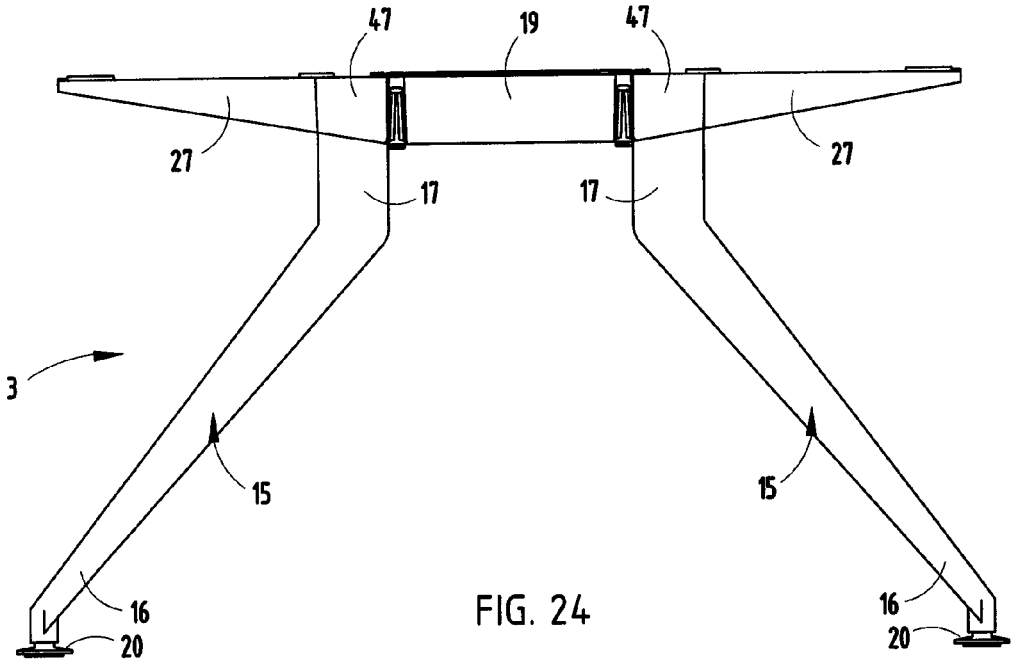
FIGS. 24 and 25 are end elevational views of the end leg.
Figure 25:
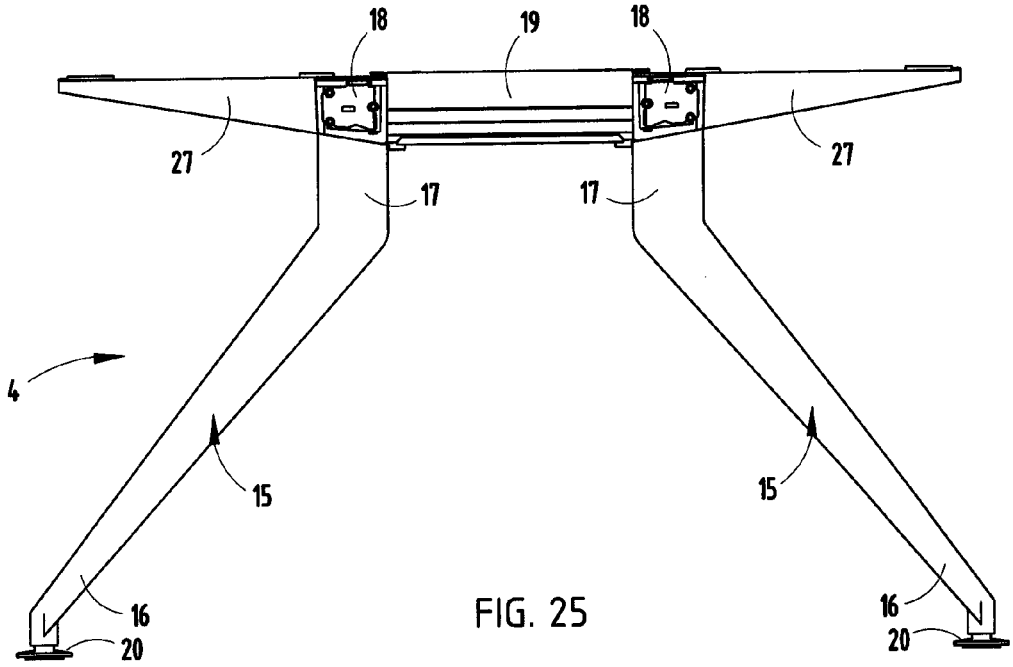

In the examples illustrated in FIGS. 3-6 and 24-25, the first and second end leg members 3 and 4 are interconnected to the opposite ends of the side rails 5 and 6, which are spaced laterally apart a predetermined distance. Each end leg member 3 and 4 is substantially identical in configuration, and includes angled leg members 15 having lower ends 16 adapted for abuttingly supporting the table 2 on an associated floor surface, and upper ends 17 connected to a three way connector block 18. Leg members 15 have a substantially identical hollow construction such that they are interchangeable and are preferably extruded from aluminum or the like. In the example illustrated in FIG. 3, a hollow end rail member 19 includes opposite ends operably interconnected between leg members 15 at the three way connector block 18 to retain leg members 15 in a laterally spaced apart relationship. In the example illustrated in FIG. 5, the lower portions 16 of leg members 15 are adapted to accept a glide 20 for abuttingly supporting leg members 15 on a floor surface. In the example illustrated in FIG. 4, the upper ends 17 of leg members 15 include a top surface 25 having apertures 24 and 26. Apertures 24 serve as fastening points for connecting the leg members 15 to the three way connector block 18, while aperture 26 is used to route cable through the leg members 15. In the examples illustrated in FIGS. 4 and 6, the leg members 15 are hollow and include a cover 21 that attaches to the leg member 15 with fasteners 22 to form the interior facing wall of leg members 15. The leg members 15 contain a series of rails or stiffeners 23 that help rigidly support the leg and allow for wires, data and other like cables to be routed through the hollow raceway portion of the leg. As shown in the illustrated example of FIG. 3, the first and second end leg members 3 and 4 also include top support arms 27 extending outwardly therefrom. FIG. 24 designates an exterior view of an assembled end leg member 3 while FIG. 25 designates an interior view of an assembled end leg member 4.

Figure 7:
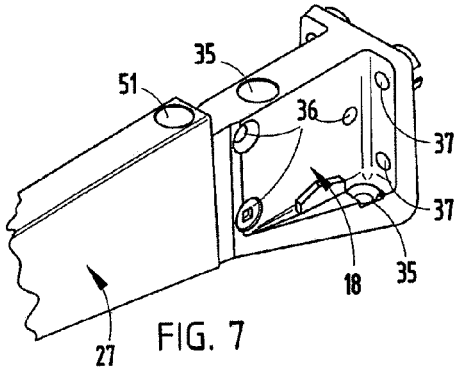
FIG. 7 is a fragmentary right-hand side perspective view of the top support member.
Figure 11:
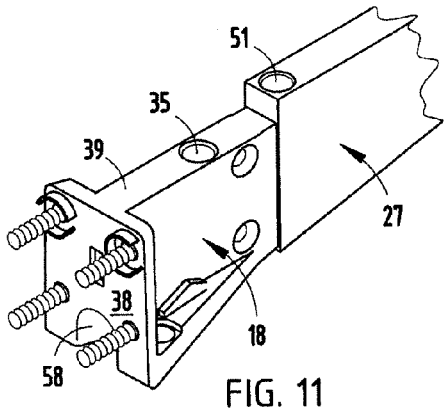
FIG. 11 is a rear fragmentary perspective view of the top support member.

In the examples illustrated in FIGS. 7-12, the top support arms 27 extending off the end leg members 3 and 4 have a generally triangular side elevational configuration (FIG. 9) including outer portions 28 configured to contact and support top members 10 (FIG. 8) and inner portions 29 having three way connector blocks 18 (FIG. 7). The top support arms 27 have apertured connector plates 30 attached to the outer portions 28 of the top support arms 27 at apertures 31 for purposes of detachably securing top members 10 to the table frame 7. The top support arms 27 are detachably connected with top members 10 and 10' by fasteners 30*a* which connect with top members 10 and 10' through apertured connector plates 30 at apertures 31. Apertured connector plates have apertures 30' which align with apertures 31 in top support arms 27. Apertured connector plates have apertures 30"

which align with are used to connect the connector plates 30 with the top members 10. Apertured connector plates 30 further include downwardly extending circular flanges 122 disposed between apertures 30' that act as guides which engage apertures 31' on the upper surfaces of top support arms 27 to ensure proper alignment of the apertured connector plates 30 with the top support arms 27.

Figure 12:
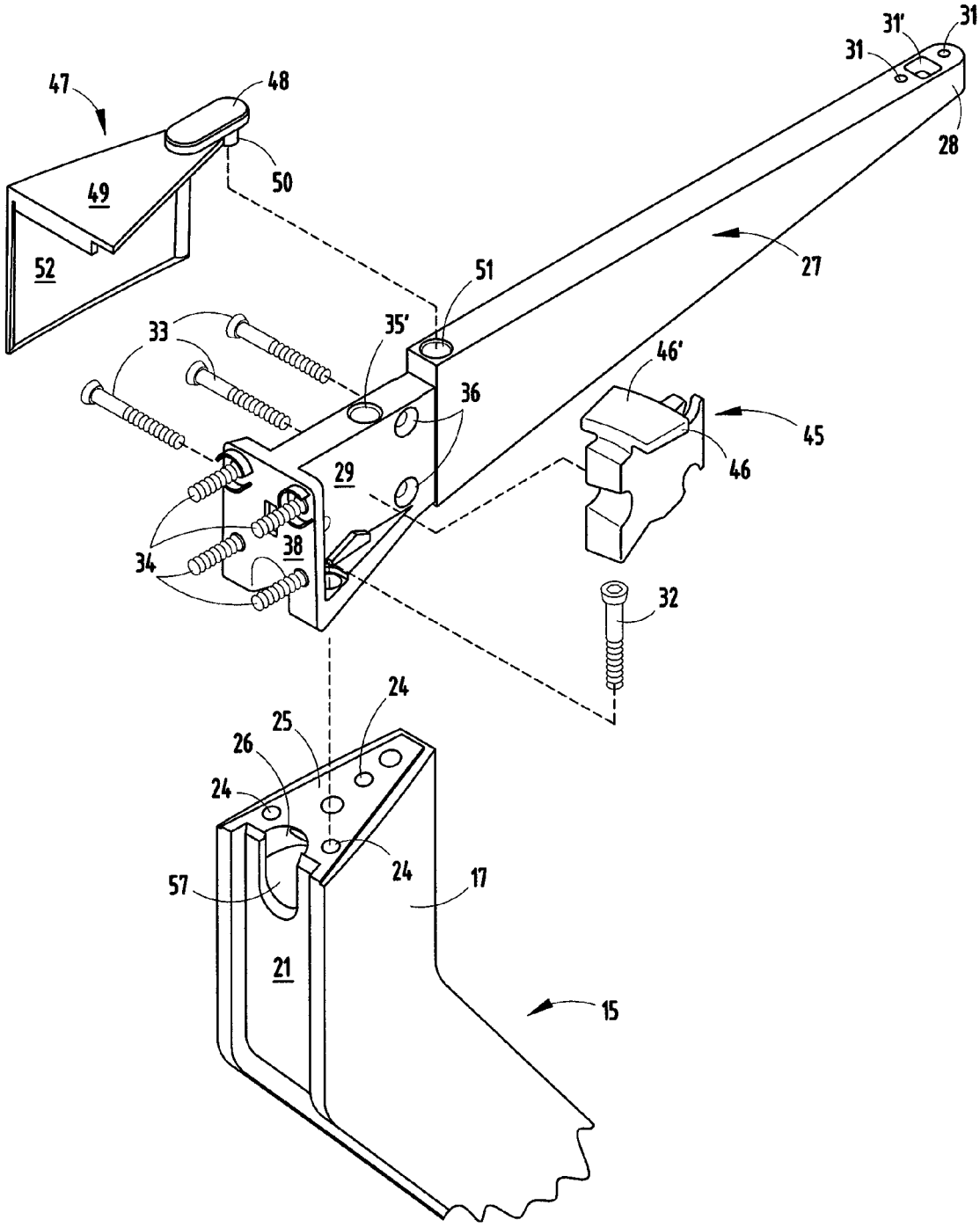
FIG. 12 is an exploded fragmentary perspective view of the leg member.
Figure 14:
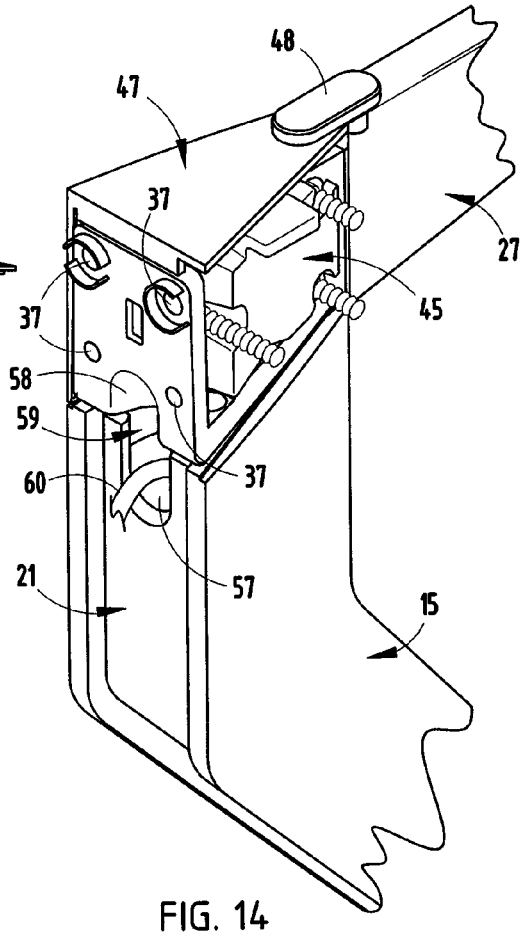
FIG. 14 is a fragmentary perspective view of the leg member, showing the wire management pathways.
Figure 15:
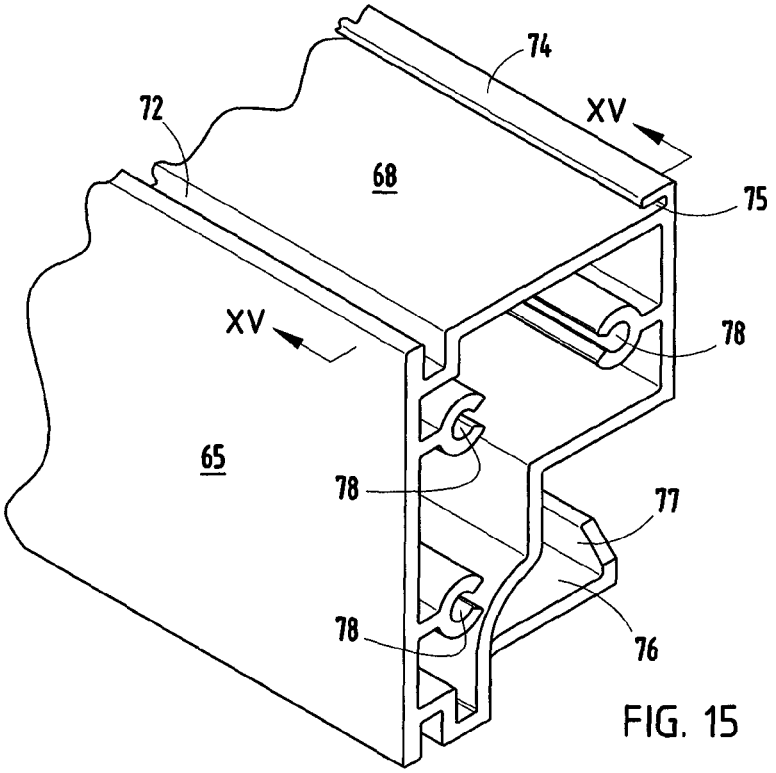
FIG. 15 is a fragmentary perspective rear view of the end rail.
Figure 16:
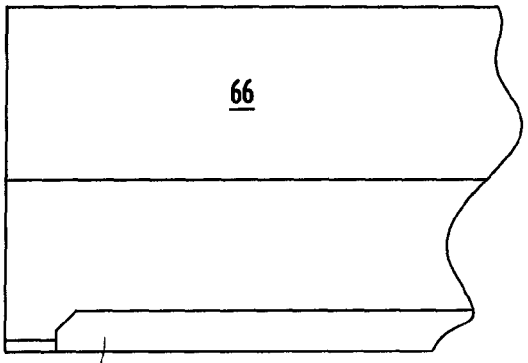
FIG. 16 is a fragmentary rear elevational view of the end rail.
Figure 17:
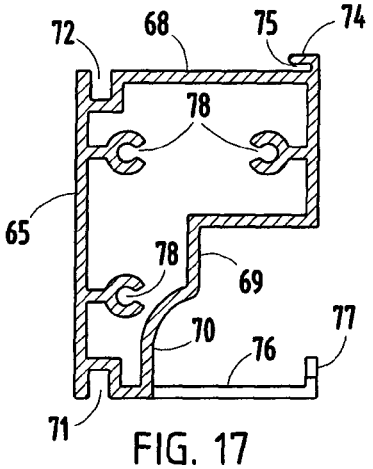
FIG. 17 is a cross-sectional view of the end rail taken along the line XV-XV, FIG. 15.
Figure 18:
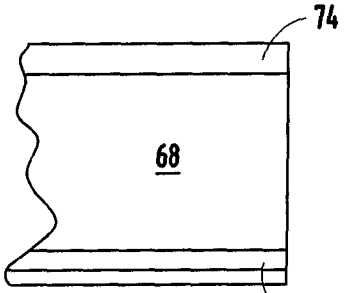
FIG. 18 is a fragmentary top plan view of the end rail.
Figure 19:
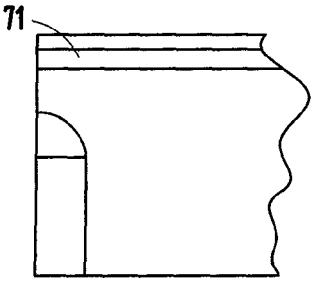
FIG. 19 is a fragmentary bottom plan view of the end rail.
Figure 19A:
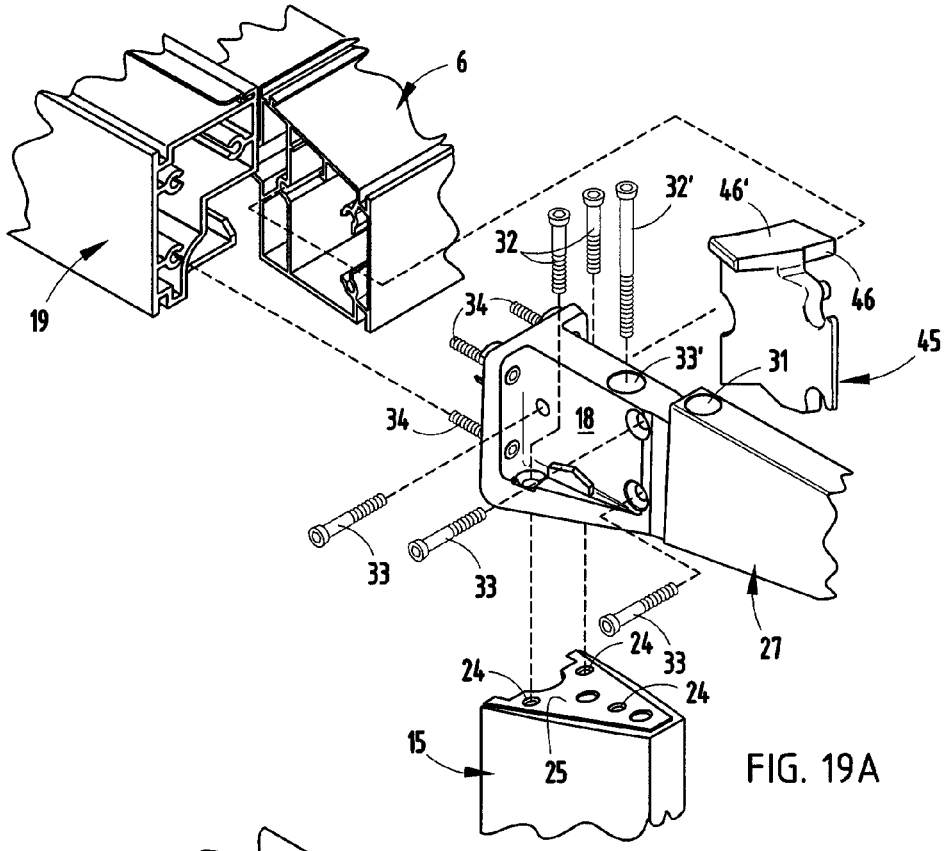
Figure 19B:
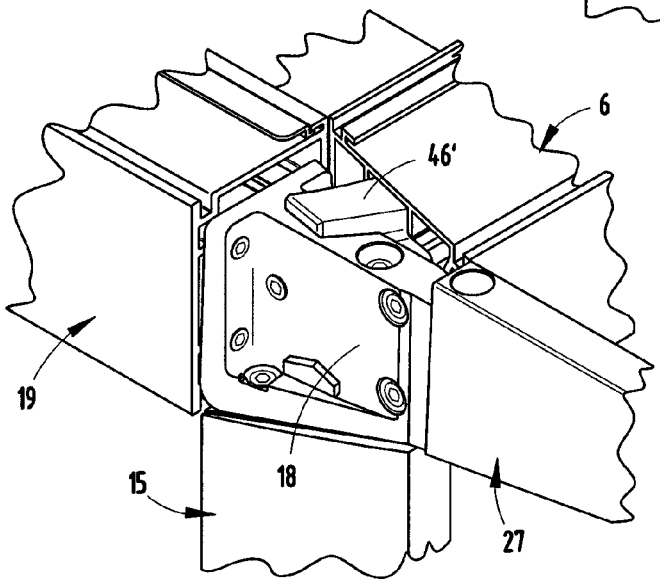
Figure 20:
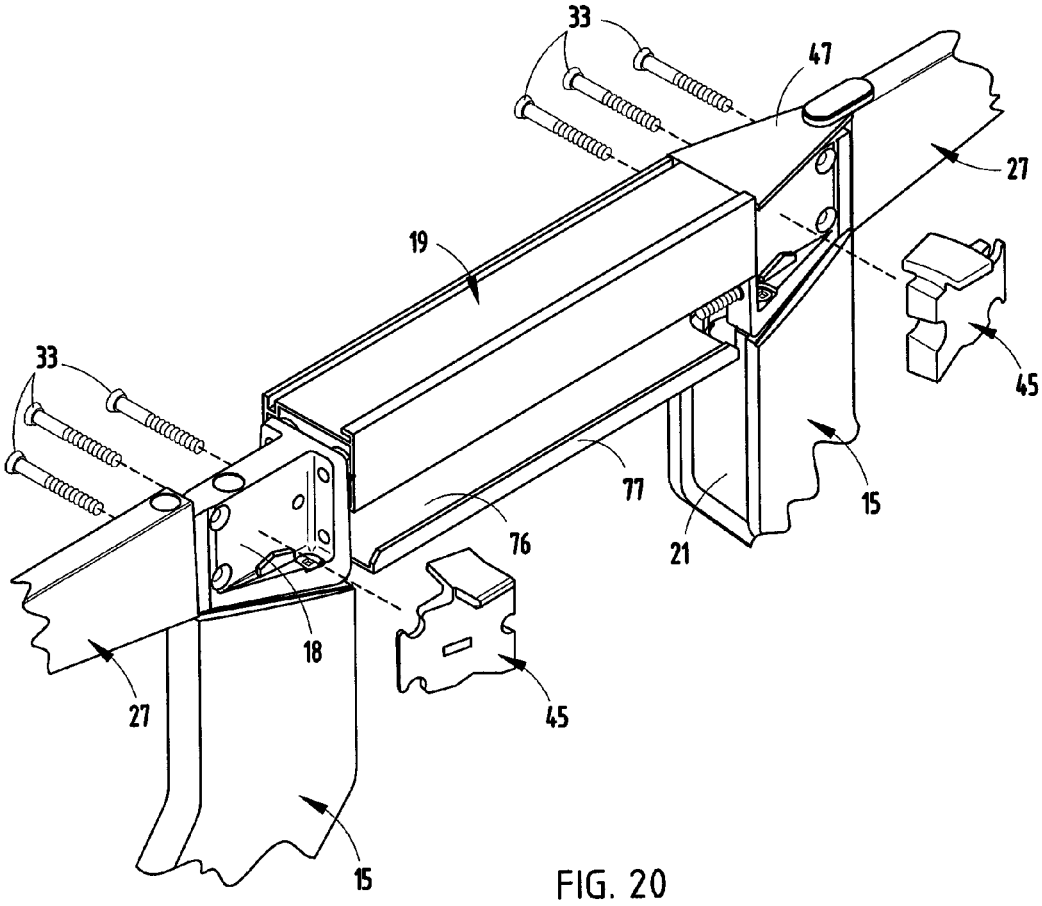
Figure 21:
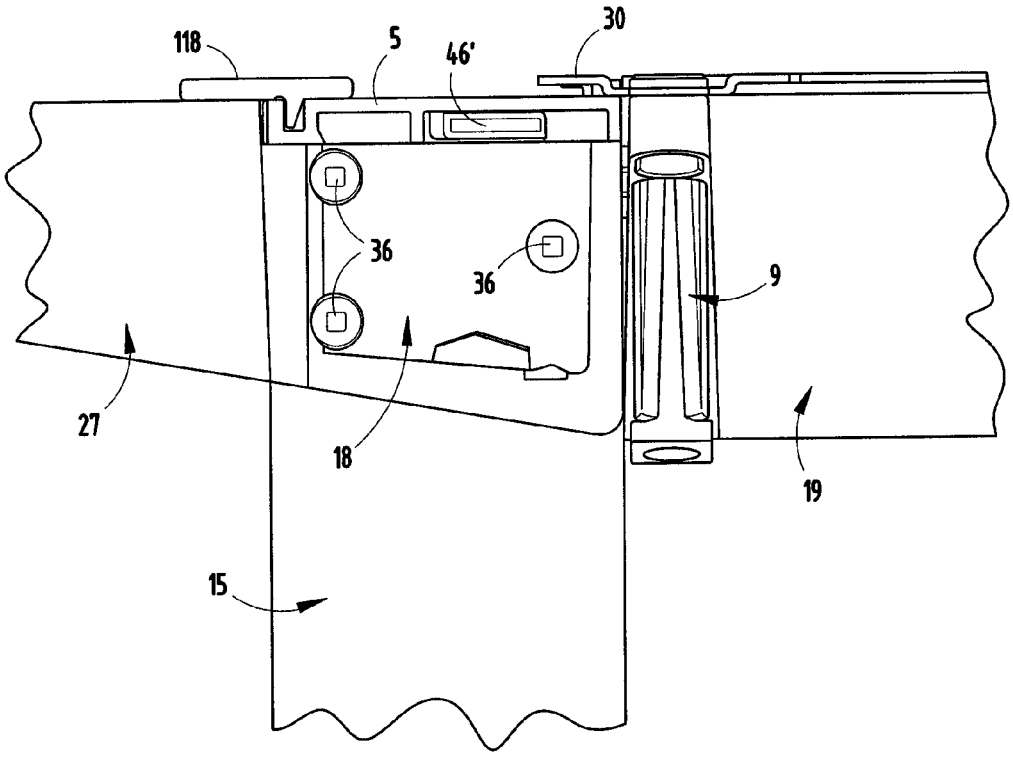
FIG. 21 is a fragmentary side elevational view of the end leg.
Figure 22:
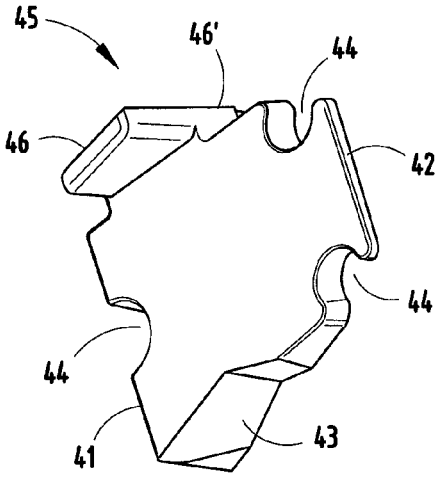
FIG. 22 is a perspective view of the spacer.
Figure 23:
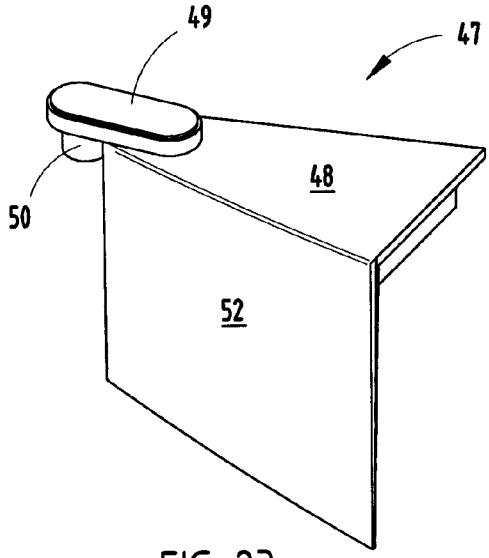
FIG. 23 is a perspective view of the corner cover.

The three way connector blocks 18 of the top support arms 27 include first connectors 32 and 32' extending generally downward through apertures 35 and 35' and detachably connecting to the upper portions 17 of the first and second leg members 15 at apertures 24, second connectors 33 extending generally inward through apertures 36 and detachably connected to the opposite ends of the first and second side rail members 5 and 6, and third connectors 34 extending generally laterally at a predetermined angle to the first connectors 31 and second connectors 32 through apertures 37 in the interior facing wall 38 of the three way connector block 18 and detachably connected with the opposite ends of the end rail member 19. Connectors 32' are elongate fasteners configured to attach the three way connector blocks 18 to the leg members top surface 25 at apertures 24 by going through the top wall 39 of the three way connector blocks 18, as shown in the illustrated example of FIG. 19A. The three way connector blocks 18 are covered with three way connector block covers 47 after assembly (FIGS. 12, 14 and 23). The three way connector block covers 47 have a top surface 48 with L-shaped clips 49 that have a cylindrical flange 50 that engages aperture 51 of top support arm 27. The three way connector block covers 47 further include an outward facing wall 52 which covers the exterior portion of the three way connector blocks 18.

In the examples illustrated in FIGS. 14, 19B and 21-22, a spacer 45 is disposed between the three way connector blocks 18 and the side rails 5 and 6. As shown in the illustrated example of FIG. 22, the spacer 45 has a generally triangular configuration defined by a horizontal upper surface 40, vertical end surfaces 41 and 42 and an inclined bottom surface 43. As shown in the illustrated example of FIG. 14, the spacer 45 is received by the three way connector blocks 18 and is configured to be nested between connectors 33. In the example illustrated in FIG. 22, the spacer 45 has semicircle apertures 44 configured to allow passage of connectors 33 through the spacer 45. Spacer 45 has outwardly extending tabs or flanges 46 and 46' disposed on the upper surface 40 of spacer 45. Flange 46 engages a T-shaped channel 53 disposed in the interior of the side rail members 5 and 6 to align the end leg members 3 and 4 with the side rails members 5 and 6, as described in more detail herein. In the examples illustrated in FIGS. 19B and 21, flange 46' is configured to rest on the top wall 39 of three way connector blocks 18 in assembly.

Figure 13:
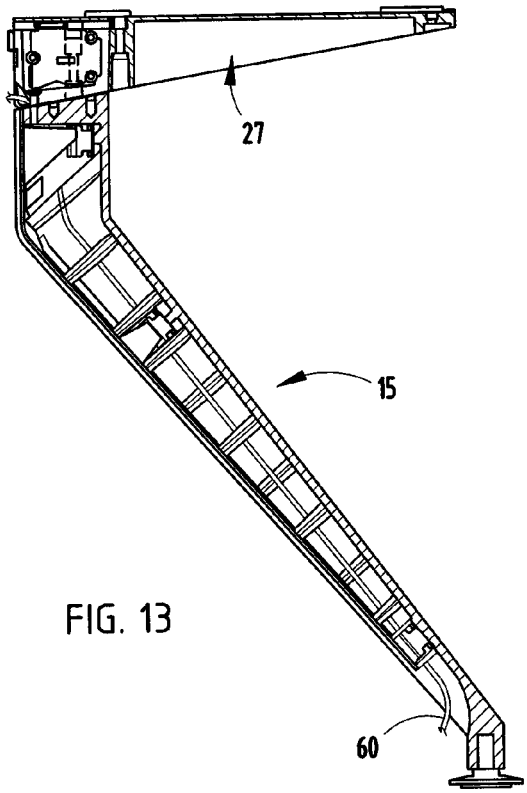
FIG. 13 is a cross-sectional side elevational view of the leg member, showing wire management pathways.

In the examples illustrated in FIGS. 13 and 14, the end leg members 3 and 4 are further adapted to route cable, data, power and the like therethrough via an aperture 57 located on the interior facing cover 21 at the upper end 17 of leg members 15. Aperture 57 is a U-shaped aperture which aligns with an aperture 58 on the inwardly facing wall 38 of three way connector block 18. Aperture 58 is an inverted U-shaped aperture, which when aligned with aperture 57 forms a complete oval aperture 59. Aperture 59 allows for a cable 60 to be routed through the hollow end rail member 19 and through the leg members 15 down to the floor surface.

In the examples illustrated in FIG. 15-20, end rail members 19 are disposed between the three way connector blocks 18, have a substantially identical construction with a hollow interior portion 64, and are preferably extruded from aluminum or like material. Each end rail member 19 is defined by a pair of horizontal extending side walls 65 and 66, a bottom wall 67 and a top wall 68 as shown in the illustrated example of FIG. 17. Interior side wall 66 further includes a stepped down portion 69 and a lower curved portion 70. A pair of elongate channels or grooves 71 and 72 are formed along the intersections of bottom wall 67 and top wall 68 with side wall 65, and serve to detachably support a plurality of cantilevered top support members 9 along the outer edges of end rail members 19, as shown in the illustrated examples of FIGS. 15, 17, 18 and 19. The top wall 68 further comprises a flange 74 which creates a U-shaped channel 75 extending the length end rail member 19 as shown in the illustrated example of FIG. 15. Channel 75 created by flange 74 is adapted to engage top members 10 described in more detail below. The end rail members 19 also have a raceway in the form of a shelf 76 extending inwardly from the lower curved portion 70 of interior side wall 66. The shelf 76 is configured to route data, power, cable and other like wiring configurations through the area covered by the end rail members 19 as shown in the illustrated examples of FIGS. 16 and 17. The shelf 76 makes up part of the end rail bottom wall 67 and further includes an upward extending flange 77 to help retain wires and cables on the shelf 76. In assembly, the shelf 76 is positioned on the bottom wall 67 of end rail members 19 to allow wiring configurations access to aperture 59 at the intersection of the three way connector block 18 and leg member 15 as shown in the illustrated example of FIG. 20. Access to aperture 59 allows cable and other like wiring configurations to be routed from the end rail members 19 through the leg members 15 to the floor surface for access to a power outlet (not shown). The end rail members also include circular channels or bosses 78 disposed within the hollow interior portion 64 of end rail members 19 which engage fasteners 34 from the three way connector blocks 18 as shown in the illustrated examples of FIGS. 15 and 19A. Two of the channels or bosses 78 extend into the interior portion 64 of end rail members 19 from exterior side wall 65. A third channel or boss 78 extends into the interior portion 64 of end rail members 19 from interior side wall 66. The circular channels or bosses 78 detachably engage fasteners 34 to rigidly retain end rail members 19 between the three way connector blocks 18 to further retain leg members 15 in a laterally spaced apart relationship as shown in the illustrated examples of FIGS. 19B and 20.

As illustrated in FIGS. 26-30, the longitudinally extending side rail members 5 and 6 have a substantially identical, hollow construction, and are preferably extruded from aluminum or like material. As shown in the illustrated examples of FIGS. 26 and 28, each side rail member 5 and 6 is generally defined by a pair of horizontal extending side walls 90 and 91, an inclined extending bottom wall 92 and a top wall 93. In the examples illustrated in FIGS. 27 and 28, the interior facing side walls 90 of side rail members 5 and 6 include an angled J-shaped flange or ledge 94 which extends downwardly and inwardly along the interior facing side walls 90 and further include an upper portion 95 which is approximately a 45 degree angle, a lower portion 96 that projects from the interior side wall 90 at a perpendicular angle and a vertical surface 94'. The ledge 94 is adapted to receive and support the utility module member 11, as further described herein. In the examples illustrated in FIGS. 28-30, a pair of elongate, vertically oriented channels or grooves 97 and 98 are formed along the intersections of top wall 93 and bottom wall 92 with exterior facing side wall 91, and serve to detachably support a plurality of cantilevered top support members 9 along the outer edges of side rails 5 and 6 as described in more detail herein. Groove 97 is an upwardly opening groove, while groove 98 is a downwardly opening groove as shown in the example illustrated in FIG. 28. An interior groove 99 is provided along the interior side of top wall 93 of side rail members 5 and 6 adjacent to the intersection of interior side wall 90 with top wall 93. The top wall 93 further comprises a flange 100 which creates an outwardly opening, horizontally oriented, U-shaped channel 101 extending the length of the beam which is further configured to engage top members 10 as described in more detail herein. In the example illustrated in FIG. 28, stiffeners 102 and 103 reside in the hollow interior portion 104 of side rail members 5 and 6 and serve to rigidify the side rails. Stiffener 102 is disposed internally between top wall 93 and bottom wall 92 of side rail members 5 and 6. Stiffener 103 is disposed at a downward angle between stiffener 103 and interior side wall 90. In the examples illustrated in FIGS. 26 and 28, side rail members 5 and 6 further comprise circular channels or bosses 105 disposed within the hollow interior portion 104 of side rail members 5 and 6. Two of the circular channels or bosses 105 extend into the hollow interior portion 104 of side rail members 5 and 6 adjacent elongate grooves 97 and 98. A third circular channel or boss 105 is formed within the profile of stiffener 102. The circular channels or bosses 100 are configured to detachably engage connectors 33 extending from three way connector blocks 18.

Figure 26:
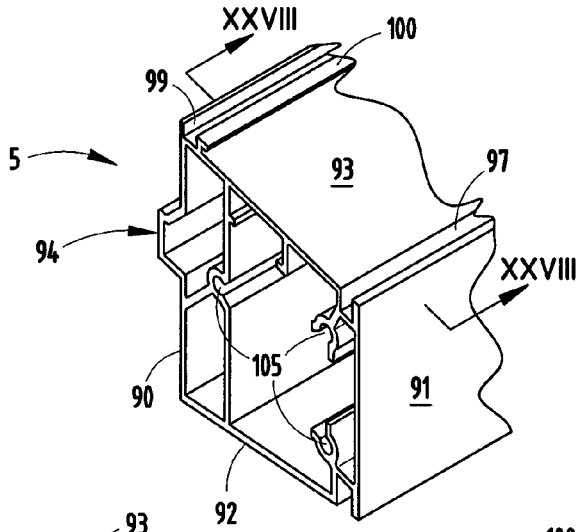
FIG. 26 is a fragmentary perspective end view of the side rail.
Figure 27:
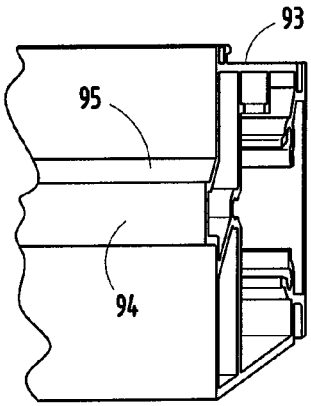
FIG. 27 is a fragmentary rear perspective view of the side rail.
Figure 28:
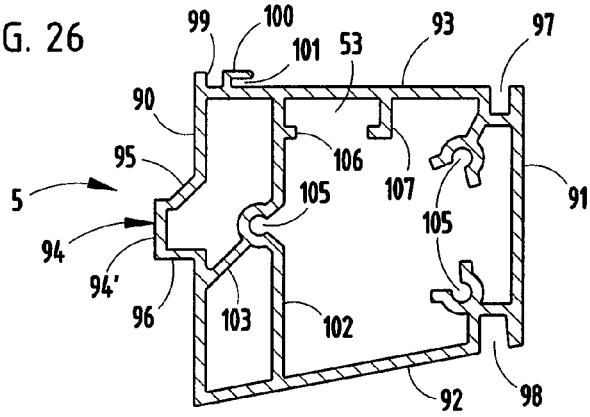
FIG. 28 is a cross-sectional view of the side rail, taken along the line XXVIII-XXVIII, FIG. 26.
Figure 29:
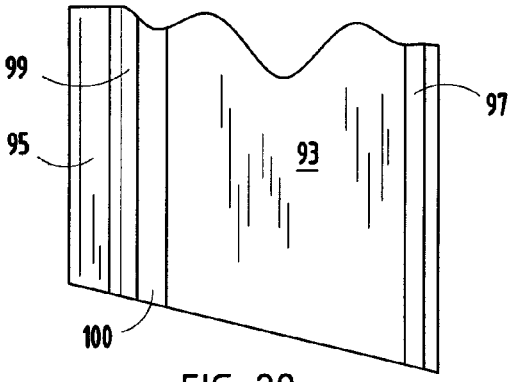
FIG. 29 is a fragmentary top elevational view of the side rail.
Figure 30:
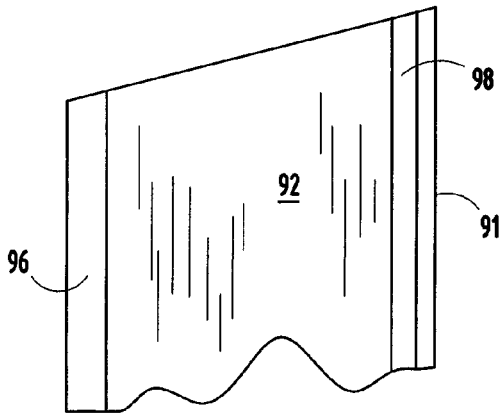
FIG. 30 is a fragmentary bottom elevational view of the side rail.
Figure 31:
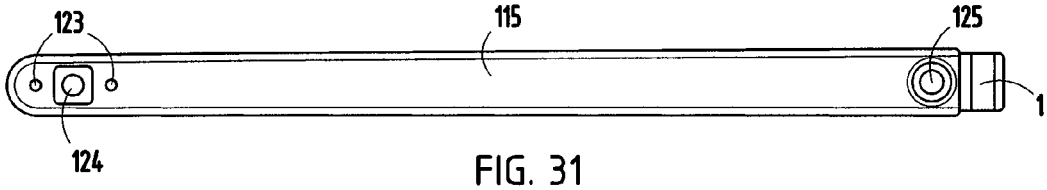
FIG. 31 is a top elevational view of the top support member.
Figure 32:
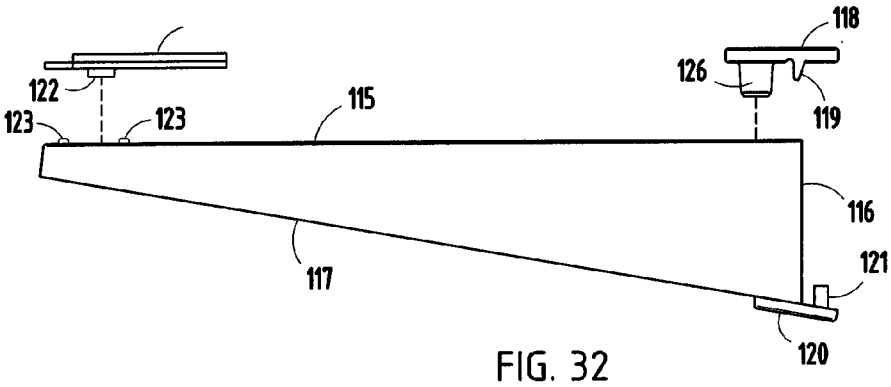
FIG. 32 is an exploded side elevational view of the top support member.
Figure 33:
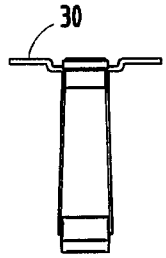
FIG. 33 is a front elevational view of the top support member.

In the examples illustrated in FIGS. 26 and 28, the side rail members 5 and 6 further include a square alignment channel 53 disposed from top wall 93 into the hollow interior portion 104 of side rail members 5 and 6. The square alignment channel 53 is formed by flange 106 extending horizontally from stiffener 102 and L-shaped flange 107 extending downward vertically from top wall 93. The square alignment channel 53 engages flange 46 of spacer 45 to help ensure that the side rail members 5 and 6 align properly with the end leg members 3 and 4 in assembly.

In the examples illustrated in FIGS. 31-35, cantilevered top support members 9 have a generally triangular side elevational configuration defined by a horizontal upper surface 115, a vertical end surface 116 and an angled bottom surface 117. As shown in the illustrated example of FIG. 34, cantilevered top support members 9 include L-shaped clips 118 and 120. L-shaped clips 118 are mounted to the upper surfaces 115 of top support members 9, adjacent end surface 116 and further include tabs or flanges 119 which extend downward vertically from clips 118 and are clampingly received and retained in the exterior grooves 97 at the outer edges of side rail members 5 and 6 to support the top support members 9 on the side rail members 5 and 6 in a cantilevered fashion. L-shaped clips 118 are detachably mounted to the upper surfaces 115 of top support members 9 at aperture 125 (FIG. 31) with cylindrical flange 126 extending downwardly from L-shaped clips 118. L-shaped clips 120 are fixedly and integrally formed from bottom surfaces 117 of top support members 9, adjacent end surface 116 and further include tabs or flanges 121 which extend upward vertically from clips 120 and are clampingly received and retained in the exterior grooves 98 at the outer edges of side rail members 5 and 6 to support the top support members 9 on the side rail members 5 and 6 in a cantilevered fashion as shown in the illustrated example of FIG. 35. As shown in the illustrated example of FIG. 34, each top support member 9 also includes an apertured connector plate 30 attached to the outermost end of top support members 9 for purposes of detachably securing top members 10 and 10' to the table frame 7. The top support members 9 are detachably connected with top members 10 and 10' by fasteners 30*a* which connect with top members 10 and 10' through apertured connector plates 30 at apertures 31. The apertured connector plates 30 attach to top support members 9 at apertures 123 on the upper surface 115 of top support members 9, as shown in the illustrated example of FIG. 31. In the example illustrated in FIG. 32, the apertured connector plates 30 further include guides 122 which engage apertures 124 on the upper surfaces 115 of top support members 9 to ensure proper alignment of the apertured connector plates 30 with the top support members 9.

Figure 8:
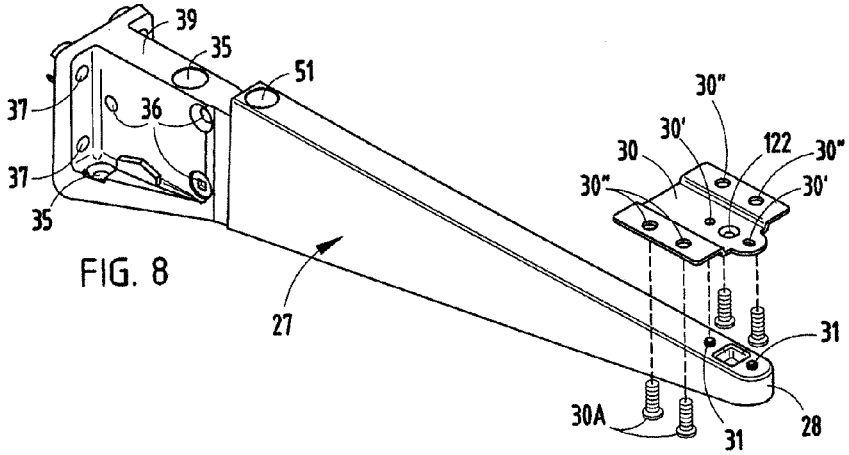
FIG. 8 is an exploded left-hand side perspective view of the top support member.
Figure 9:
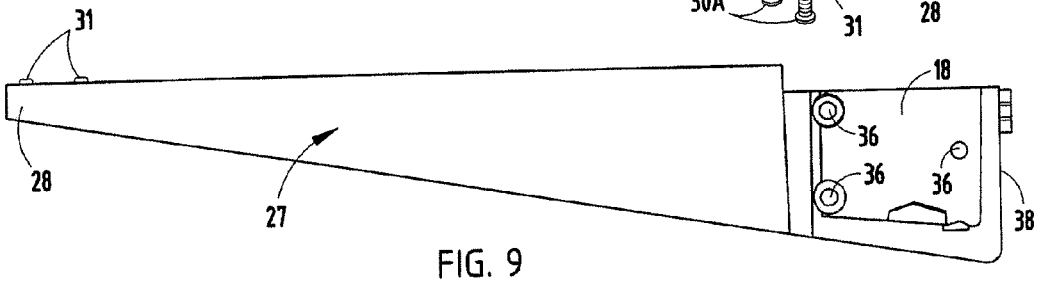
FIGS. 9 and 10 are side and bottom elevational views of the top support member.
Figure 10:
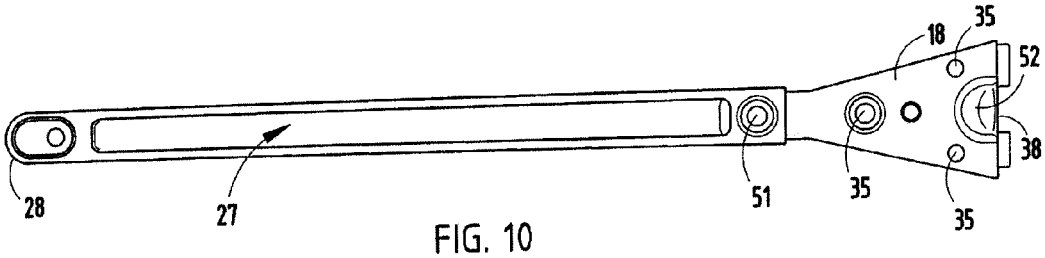
Figure 34:
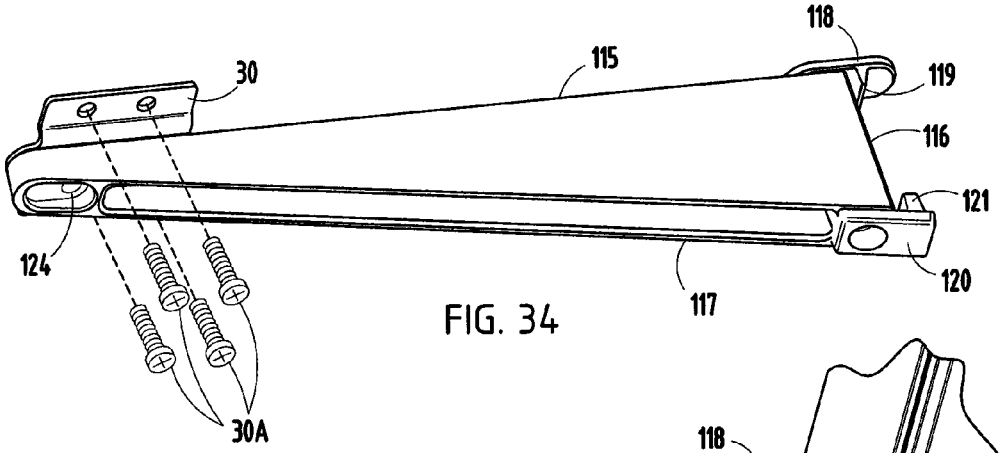
FIG. 34 is a perspective view of the top support member.
Figure 35:
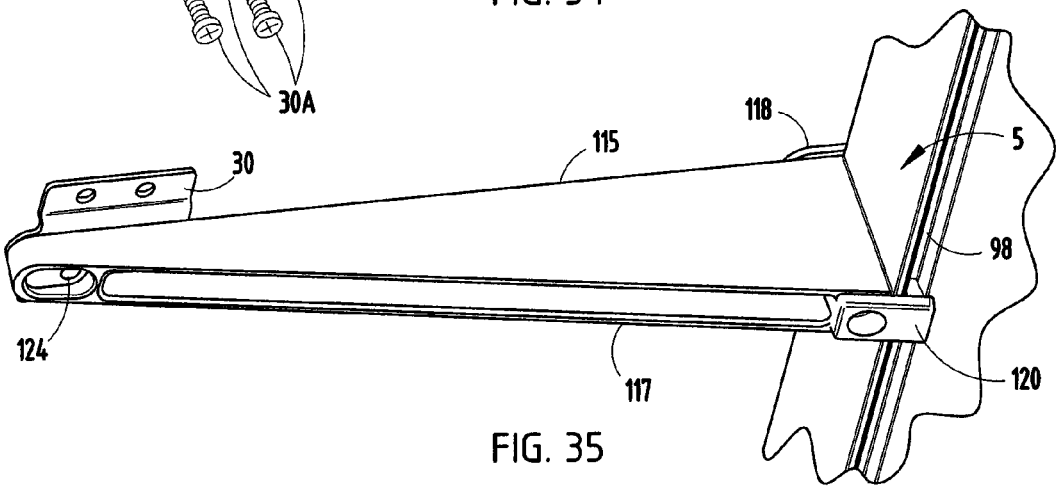
FIG. 35 is a perspective view of the top support member, shown connected to the side rail.
Figure 38:
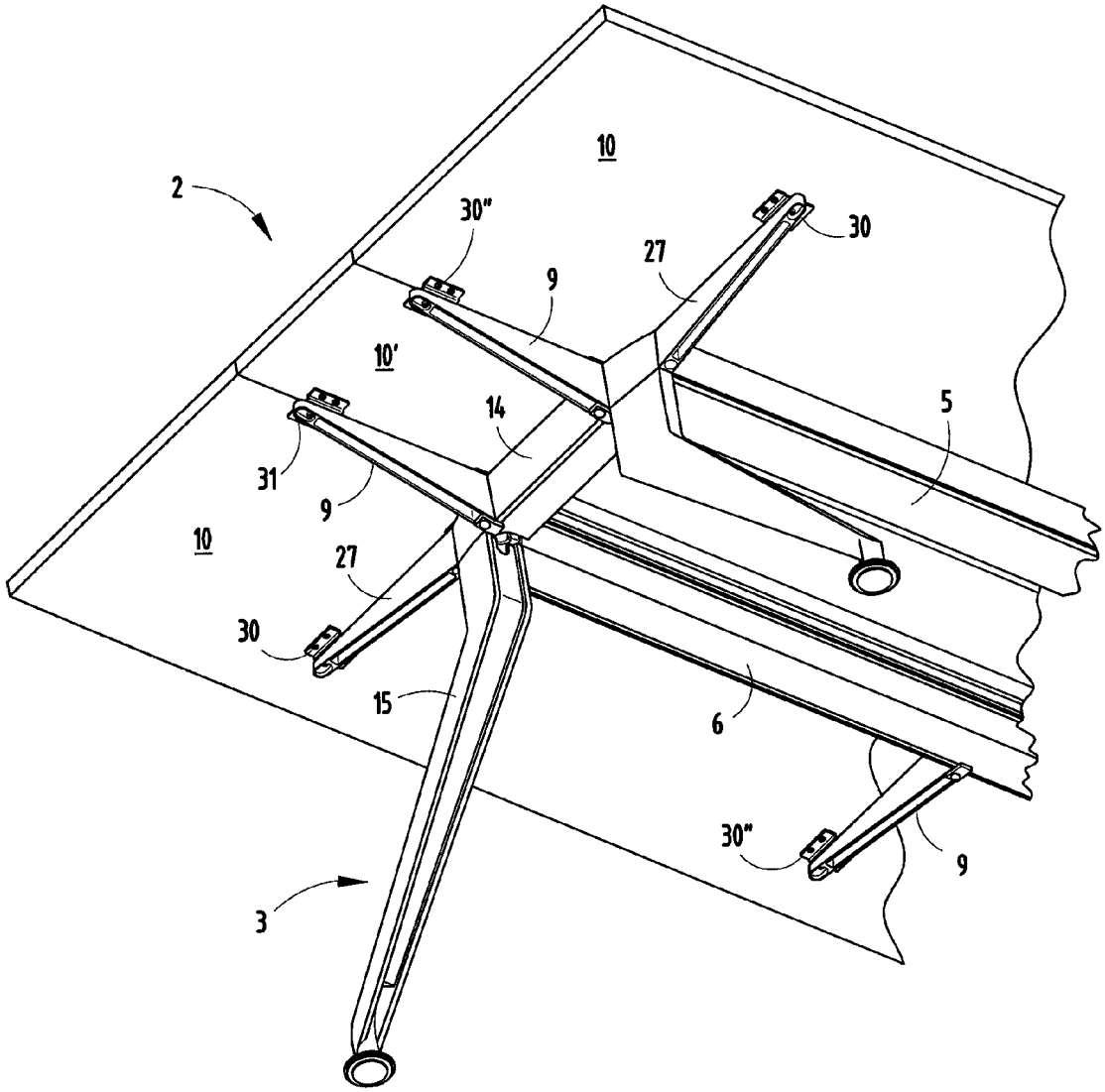
FIG. 38 is a fragmentary bottom perspective view of the table frame, shown with top members supported thereon.
Figure 39:
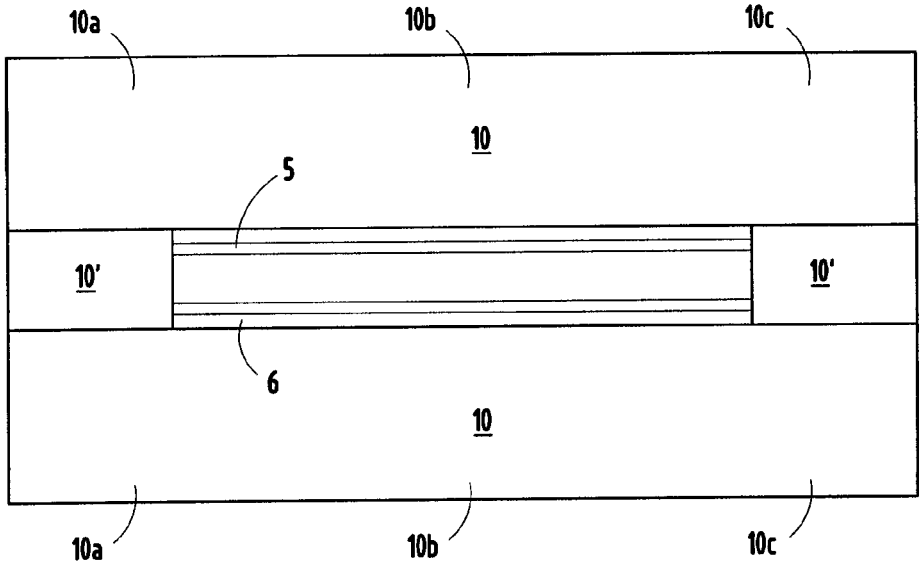
FIG. 39 is a top plan view of the table.

In the examples illustrated in FIGS. 38 and 39, top members 10 and 10' are connected with table frame 7 and supported on and connected with top support members 9 and top support arms 27. Top members 10 and 10' are detachably connected with top support members 9 and top support arms 27 by fasteners 30*a* as shown in FIGS. 8 and 34. Again, as shown in the example illustrated in FIG. 39, each top member 10 is of sufficient length to form multiple workstations 10*a*-10*c* arranged in a side-by-side relationship, which can be accessed anywhere along the outer edges of top members 10. Although the examples of FIGS. 38 and 39 show a four piece worksurface, the present invention also contemplates a table construction with a unitary worksurface.

Figure 40:
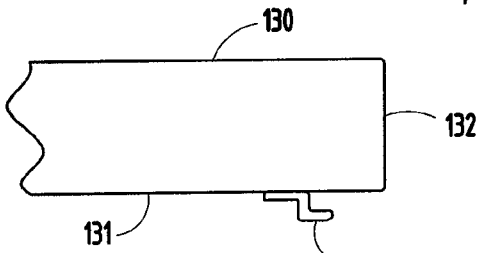
FIGS. 40 and 41 are fragmentary side elevational views of top members.
Figure 41:
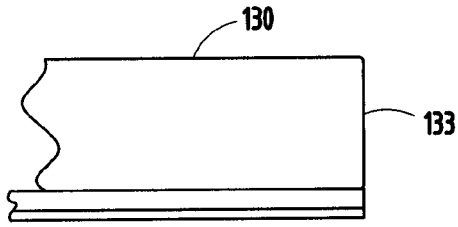
Figure 42:
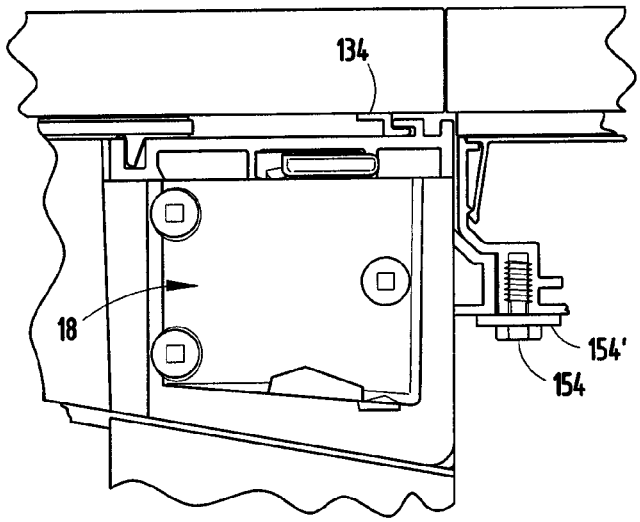
FIG. 42 is a fragmentary elevational view of a top member, shown connected to a side rail.

FIGS. 40-42 generally designate the top members 10 having an upper surface 130, a lower surface 131, an interior side 132, and an exterior side 133. FIGS. 40 and 42 show a bracket 134 on the lower surface 131 near the intersection of the lower surface 131 and interior side 132 of the top member 10. The bracket 134 is a Z-shaped bracket extending horizontally along the length of the top members 10. The bracket 134 is designed to engage the channel 101 created by the flange 100 on the top wall 93 of side rail members 5 and 6 as shown in the illustrated example of FIG. 42. The top members 10 and 10' are also detachably supported by the top support members 9 located at various points along the side rail members 5 and 6 and end rail members 19, as wells by top support arms 27 extending from end leg members 3 and 4.

Figure 43:
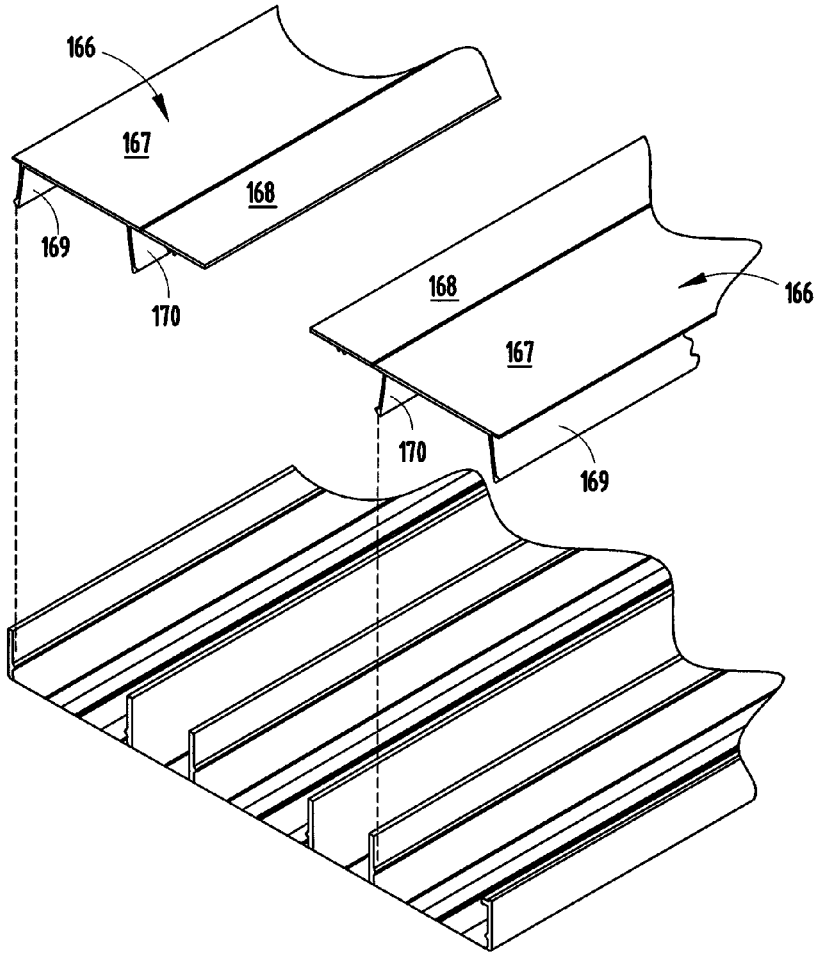
FIG. 43 is a fragmentary exploded perspective view of the trough member.
Figure 44:
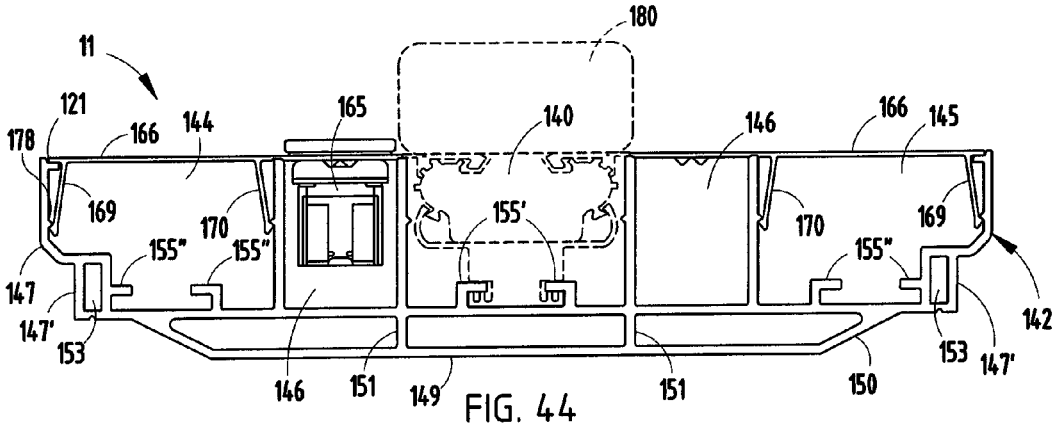
FIG. 44 is and end elevational view of the trough member

The utility module member 11 shown in FIGS. 43 and 44 is in the form of a trough that is configured to mount various utilities therein. As shown in the example illustrated in FIG. 44 the trough 11 has a one-piece, hollow box-like construction generally defined by upstanding exterior sides 147 and a lower surface 148. As shown in FIG. 43 and 44, the trough 11 further includes a plurality of upward opening channels or raceways extending longitudinally the length of the trough 11.

Figure 46:
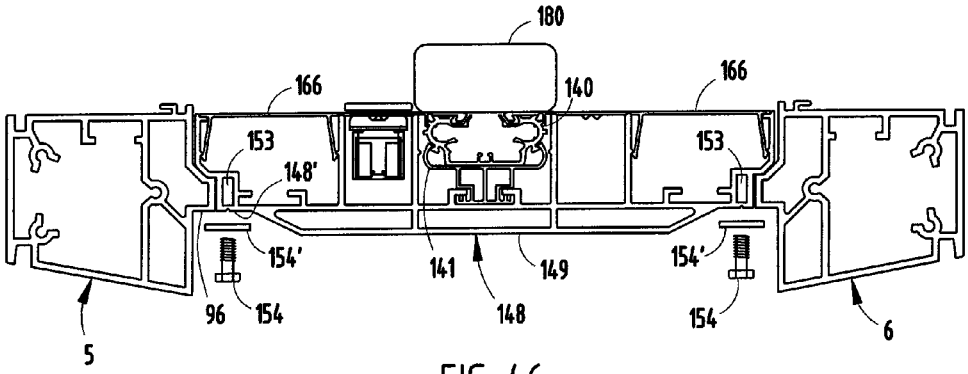
FIG. 46 is a side elevational view of the trough member and side rails.
Figure 48:
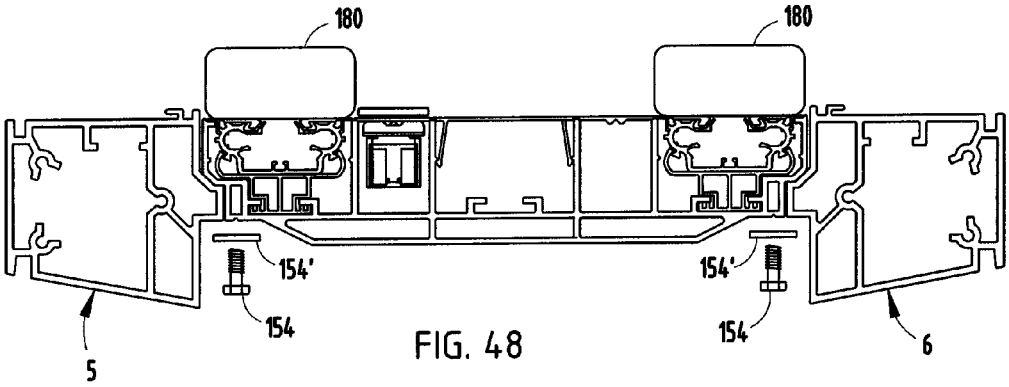
FIG. 48 is an end elevational view of the trough member and side rails.
Figure 49:
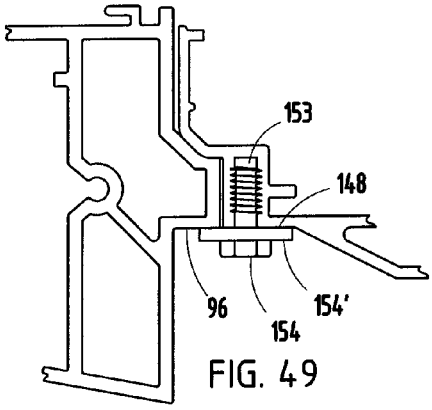
FIG. 49 is a fragmentary end elevational view of the trough member and side rails.

As shown in the illustrated examples of FIGS. 44 and 46, the upstanding exterior sides 147 of the trough 11 are tapered inwardly with a corresponding J-shaped angle as the protruding J-shaped ledge 94 of the interior side walls 90 of side rail members 5 and 6. The exterior sides 147 of the trough 11 have a vertical surface 147' that rests adjacent to vertical surface 94' of the protruding J-shaped ledge 94 of the interior side walls 90 of side rail members 5 and 6. The exterior sides 147 of the trough 11 are thus formed to wedgingly mate with the flange or ledge 94 of side rails 5 and 6, as shown in detail in the illustrated example of FIG. 46. Thus, the ledge 94 of side rails 5 and 6 laterally captures the trough 11 in the window 8 of table frame 7 between the side rails 5 and 6. In the example illustrated in FIG. 46, the trough 11 includes a downwardly opening channel shaped fastener boss 153 disposed on the planar stepped down portion 148' of the lower surface 148 of utility module member 11 adapted to receive fasteners 154 and washers 154'. Each washer 154' (also shown in FIGS. 42, 48 and 49), overlaps the horizontal lower portion 96 of ledge 94 of the side rails 5 and 6 and stepped down portion 148' of lower surface 148 of the trough 11 to positively vertically capture the trough 11 within the side rails 5 and 6. The above-described drop-into-place mounting of the trough 11 provides secure support, yet is readily detachable to permit the table to be easily reconfigured with different utility trough designs to accommodate various technology needs and applications. The fasteners 154 and washers 154' serve to positively capture the trough 11 between the side rails 5 and 6, and yet allow for easy removability of the trough 11 for other applications.

In the examples illustrated in FIGS. 44 and 46, the lower surface 148 of the trough 11 has planar stepped down surfaces 148' disposed on the exterior most portions of lower surface 148. The lower surface 148 of trough 11 has a planar surface 149 that is disposed between angled portions 150 that extend upwards towards planar stepped down portions 148'. The lower surface 148 of the trough 11 has stiffeners 151 that extend from the planar surface 149 of lower surface 148, to a midline stiffener 152 that forms the bottom surface of power channels 143, 144, and 145 and data channels 146.

In the example illustrated in FIG. 44, the upward opening channels of trough 11 are designated as a center power channel 143, exterior power channels 144 and 145, data channels 146. In the embodiment shown in FIGS. 43 and 44, the trough 11 is configured with a center power channel 143, two exterior power channels 144 and 145, and two data channels 146 disposed between the center power channel 143 and exterior power channels 144 and 145. The data channels 146 are used to supply data, power and the like to various points along the trough 11. The power channels 143, 144, and 145 further include centrally located T-shaped channels 155 formed by L-shaped flanges 155' and horizontally extending flanges 155" extending the length of the trough 11 and used to retain power module bracket 141. Central power channel 143 includes T-shaped channel 155 formed by 2 oppositely facing L-shaped flanges 155' while exterior power channels 144 and 145 have T-shaped channels 155 formed by L-shaped flanges 155' and horizontally extending flanges 155". As shown in the illustrated example of FIG. 44, the data channels 146 may include a communications module or data port 165 for allowing users access to data and telecommunication sources. As shown in the illustrated example of FIG. 44, the trough 11 may also house a power module 140 (not shown). When not in use, the power channels and data channels can be covered by removable covers 166 to protect the unused channels and wiring which may be housed therein. The removable covers 166 include upper portions 167 and 168. Upper portion 167 covers the power channels such as power channels 143, 144, and 145. Upper portion 168 is used to cover data channels such as data channels 146. As shown in the illustrated examples of FIGS. 43 and 44, the removable covers 166 further include angled downwardly protruding sides 169 and 170 which extend down form the upper portion 167 of the covers 166. The angled downwardly protruding sides 169 and 170 act as living hinges and extend downward into the unused power channels such as exterior power channels 144 and 145 as shown in the illustrated example of FIG. 44. The exterior sides 147 of the trough 11 include ledges 171 disposed at the top of the exterior sides 147 which re configured to engage the upper portions 167 of covers 166. The exterior sides 147 of the trough 11 further include flanges 172 which positively capture the living hinges created by angled downwardly protruding sides 169 and 170.

Figure 44A:
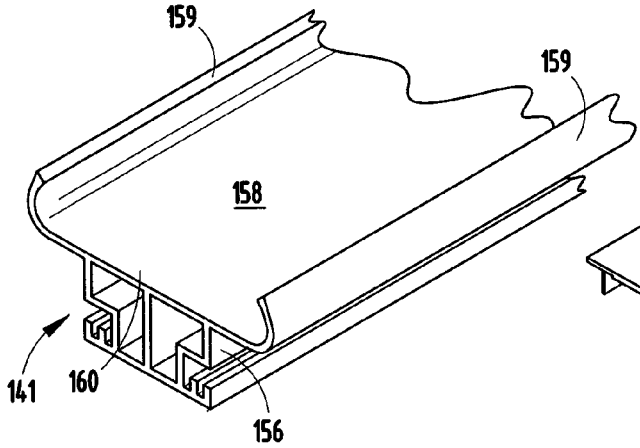
FIG. 44A is a fragmentary perspective view of the power module bracket.

In the examples illustrated in FIG. 44A, a power module bracket 141 is configured to engage the power channels 143, 144, and 145 at any location along the utility module member 11. The power module bracket 141 includes a generally T-shaped bottom portion 156 designed to fit in the T-shaped center channels 155 of the power channels 143, 144, and 145 of the trough 11 as shown in the illustrated example of FIG. 46. The power module brackets 141 also include a top portion 157 which has a generally flat planar surface 158 with curved ends 159 that are configured to form generally a C-shaped channel 160 as shown in FIG. 44A.

Figure 2:
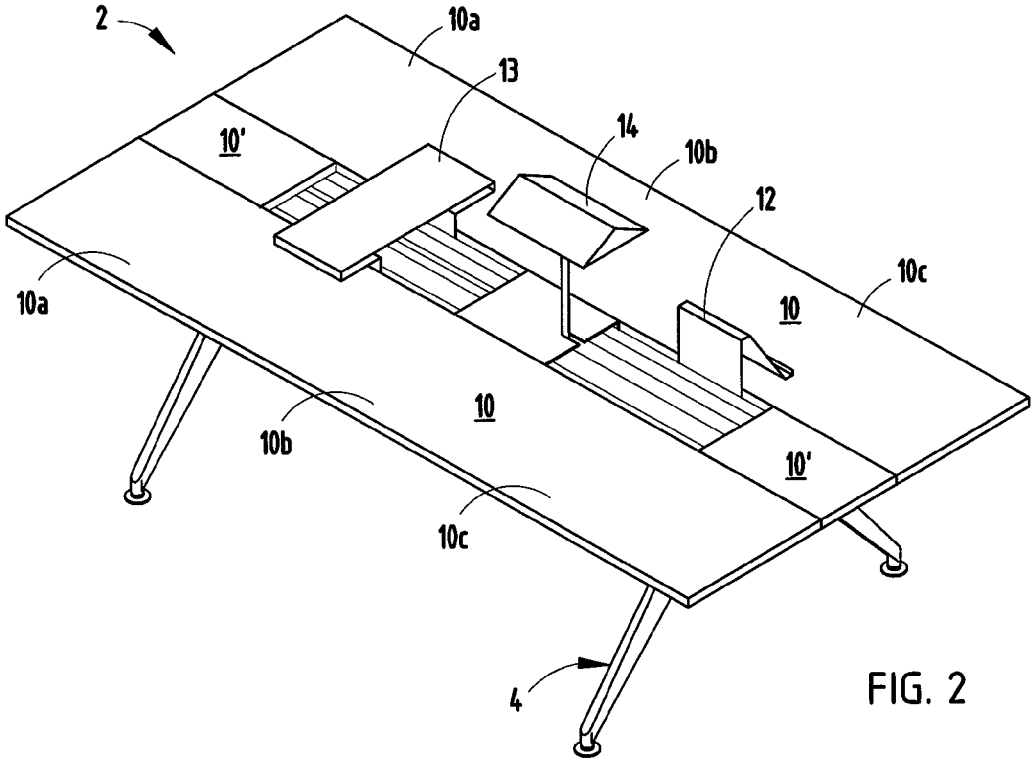
FIG. 2 is a perspective view of another embodiment of the present invention including table accessories.
Figure 3:
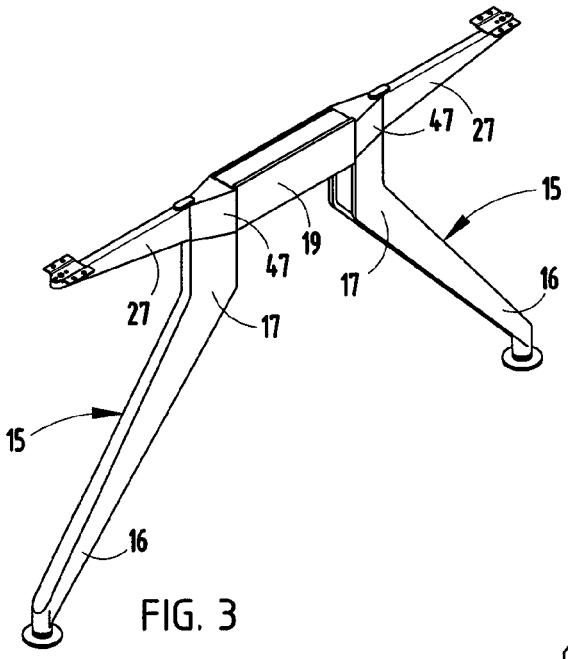
FIG. 3 is a perspective view of an end leg portion of the table, including an end rail connecting opposite legs, and top support members.
Figure 5:
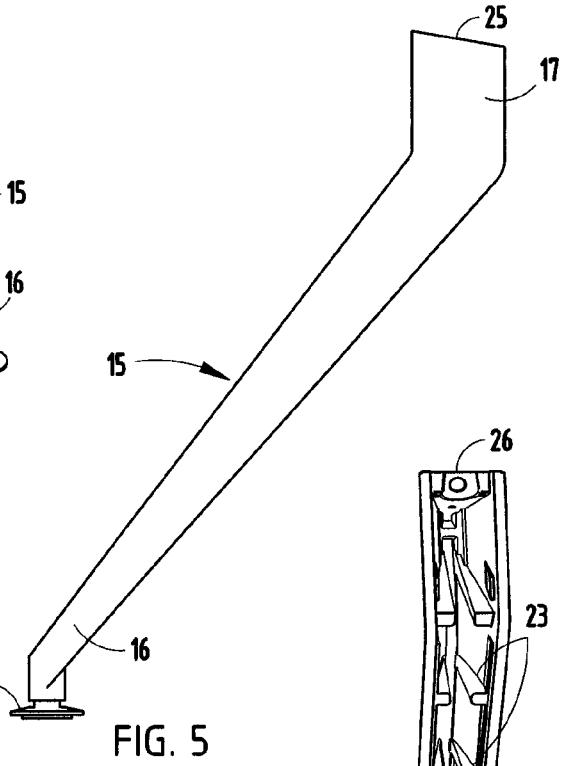
FIG. 5 is an elevational view of the leg.
Figure 4:
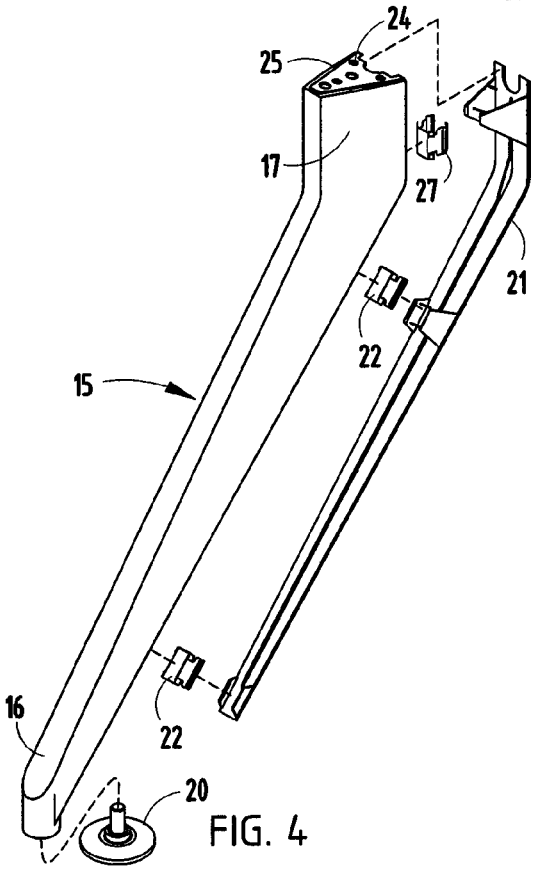
FIG. 4 is an exploded perspective view of the leg.
Figure 6:
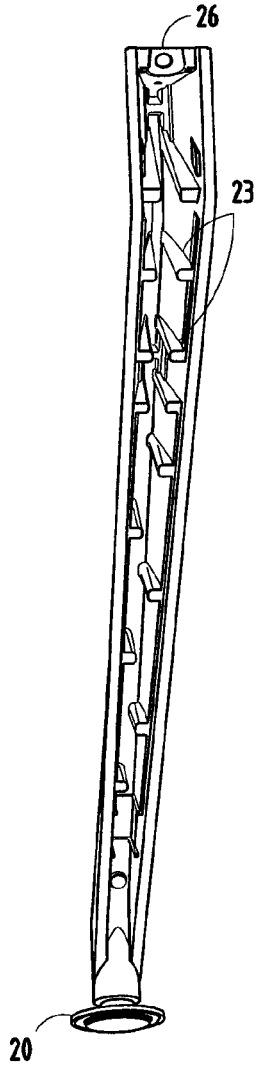
FIG. 6 is a rear perspective view of the leg.

A variety of utilities can be configured to mount to the trough 11 at various points including power channels 143, 144, and 145. The various utilities can include a T-shaped bottom portion similar to the bottom portion 156 of the power module bracket 141 to be received in the T-shaped center channels 155 of power modules 143, 144, and 145. Such accessories can include but are not limited to a privacy screen, a task light 14 and a shelf accessory 13 as shown in FIG. 2. Many of these accessories can also be set on the trough member with out engagement of the T-shaped center channels 155 of power modules 143, 144, and 145.

Figure 44B:
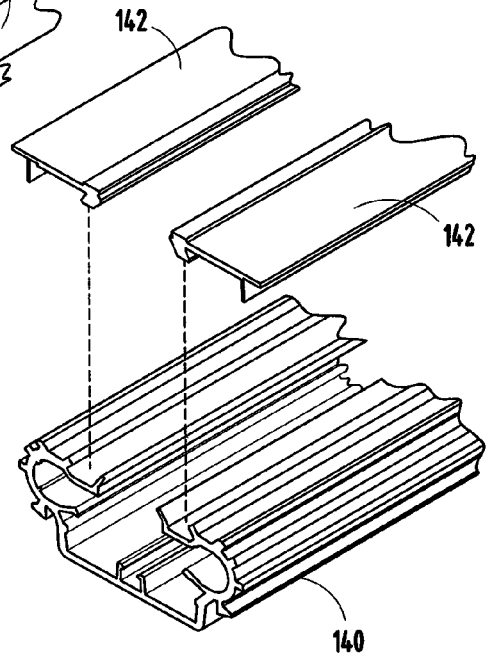
FIG. 44B is a fragmentary exploded perspective view of the power module.
Figure 44C:
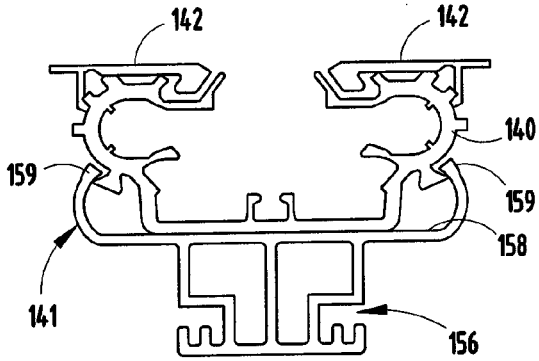
FIG. 44C is an end elevational view of the power module bracket and power module.
Figure 44D:
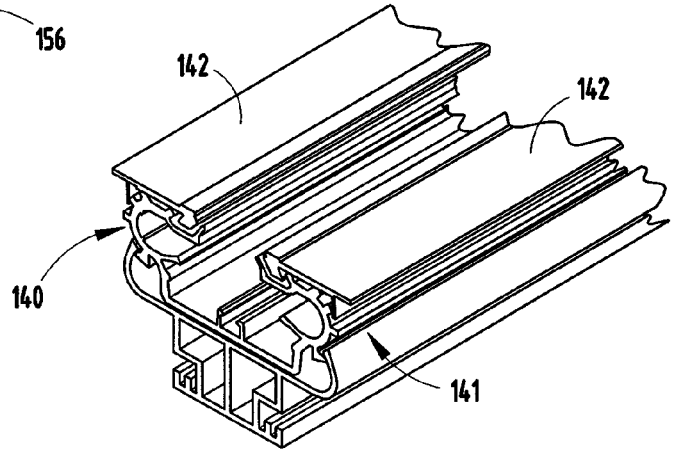
FIG. 44D is a fragmentary perspective view of the power module bracket and power module.

FIGS. 44B-44D generally designate a power module 140 that can be used with the present invention. FIG. 44B is an exploded view of the power module 140 and the power module covers 142. FIGS. 44C and 44D, show the power module of FIG. 44B connected with the power module bracket 141. Specifically, in the examples illustrated in FIGS. 44C and 44D the power module 140 is connected with the power module bracket 141 by engaging the C-shaped channel 160 of power module bracket 141. In one embodiment of the present invention, the power module 140 is a Recess Data Track as provided commercially by Eubiq™ as shown in the illustrated examples of FIGS. 44B-44D, however, it is contemplated that other power modules can be used with the present invention as described.

Figure 45:
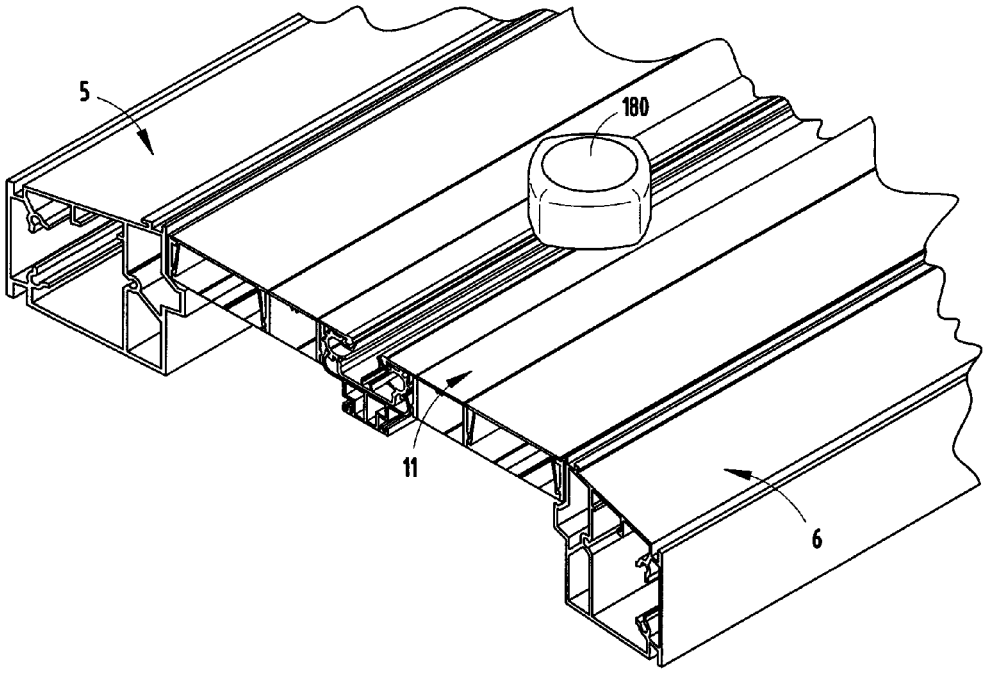
FIG. 45 is a fragmentary perspective view of the trough member supported on the side rails.
Figure 47:
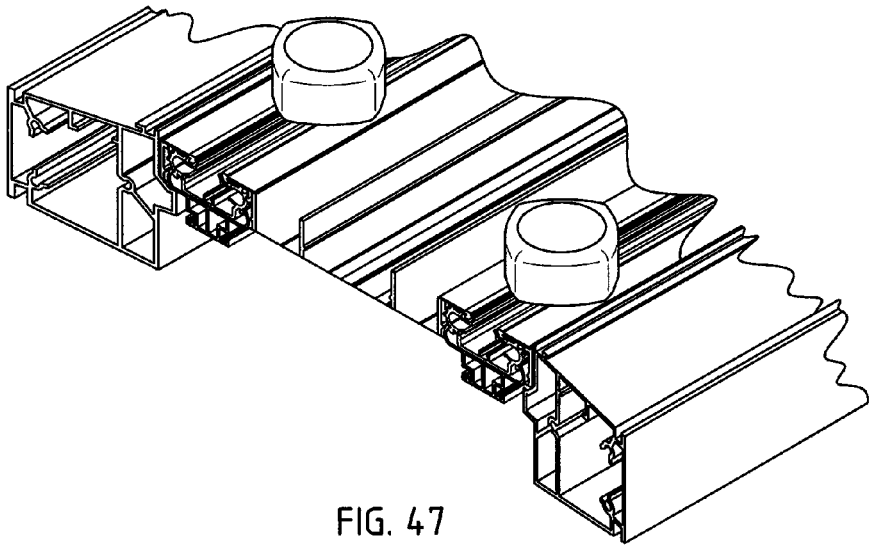
FIG. 47 is a fragmentary perspective view of the trough member and side rails.

In the example illustrated in FIG. 45, a power outlet 180 is shown plugged into the power module 140 in the center power channel 143 of the trough 11. In the examples illustrated in FIGS. 47 and 48, the trough 11 is shown in a different configuration such that power channels 144 and 145 now contain the power modules 140 and the power outlets 180 are disposed thereon. Thus, in this configuration the center power channel 143 is open for attachment of accessories or to be covered by removable covers 166.

Figure 50:
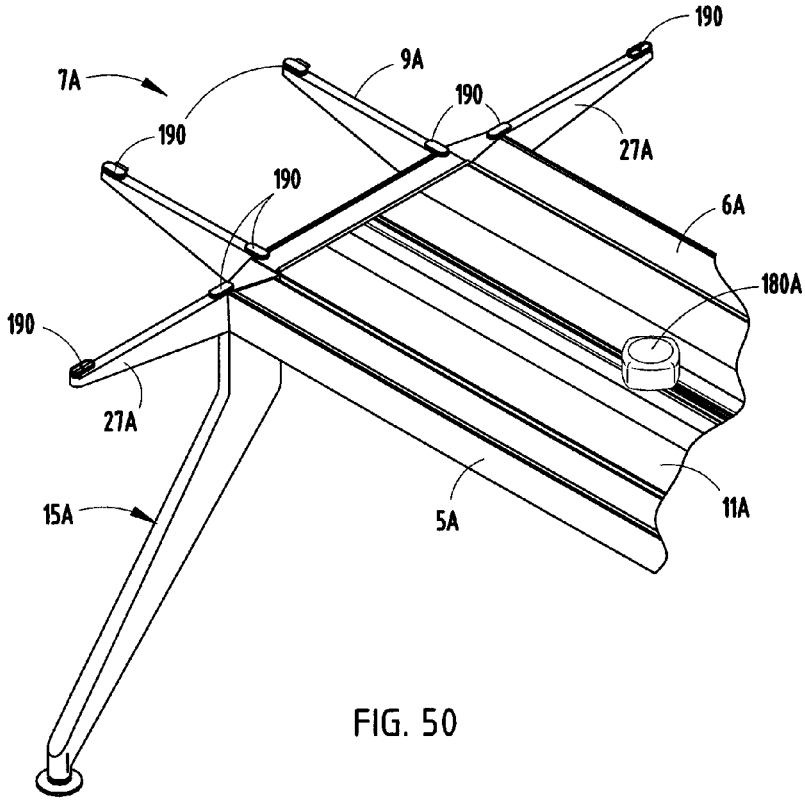
FIG. 50 is a fragmentary top perspective view of the table frame and trough member of another embodiment of the present invention.
Figure 51:
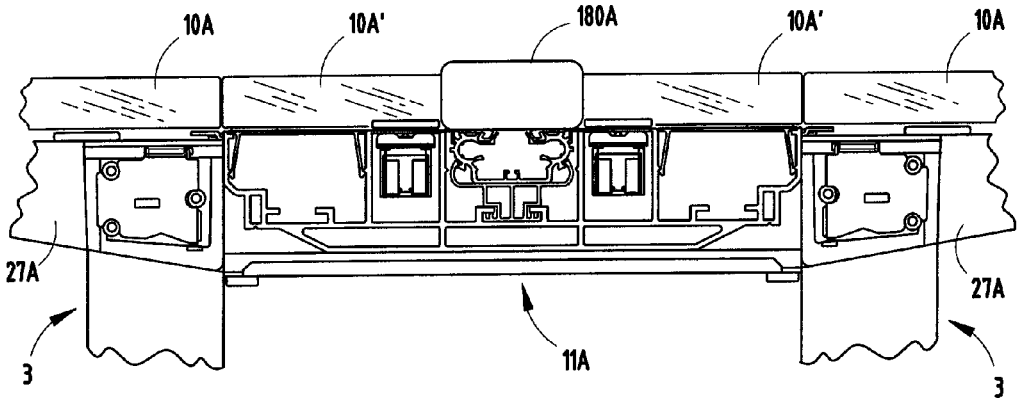
FIG. 51 is a fragmentary end elevational view of the trough member, side rails and top members of another embodiment of the present invention.

The reference numeral 2A (FIGS. 50-55) generally designates another embodiment of the present invention. Since table 2A is similar to the previously described table 2, parts appearing in FIGS. 1, 2, 38 and 42 are similar to parts appearing in FIGS. 50-55. Thus, similar parts are represented by the same corresponding reference numerals, except for the suffix "A" is used in the numerals for parts defining table 2A. Table 2A, as shown in the illustrated examples of FIGS. 52, 53 and 55, includes top members 10A and 10A' composed of glass, plastic or other like transparent material. In the example illustrated in FIGS. 50A, 54 and 54A, top support members 9A have L-shaped clips 118A that are mounted to the upper and bottom surfaces 115A and 117A of top support members 9A, adjacent end surface 116A and are clampingly received into the exterior 97A and 98A at the outer edges of side rail members 5A and 6A to support top support members 9A on the side rail members 5A and 6A in a cantilevered fashion. The L-shaped clips 118A on the upper surfaces 115A of top support members 9A include a pad 190 which serve as contacts for adhering top members 10A or for frictionally holding the glass top members 10A in place. Each top support member 9A also includes a bracket 191, a pad bracket 192 and a pad 190 disposed on the outermost portion of top surface 115A of top support member 9A. The pad 190 is configured to adhere to the top members 10A and 10A' or frictionally hold the glass top members 10A and 10A' in place in assembly. The bracket 191 fastens to the upper surface 115A of top support arm 9A at apertures 123A through apertures 193 disposed on bracket 191. Bracket 191 further includes a square shaped aperture 194. In the example illustrated in FIG. 54, the pad bracket 192 includes a square shaped flange 195 which engages the square shaped aperture 194 of bracket 191 and further engages aperture 124A on the upper surfaces 115A of top support members 9A to ensure proper alignment of the bracket 191 and pad bracket 192 with the top support members 9A.

Figure 52:
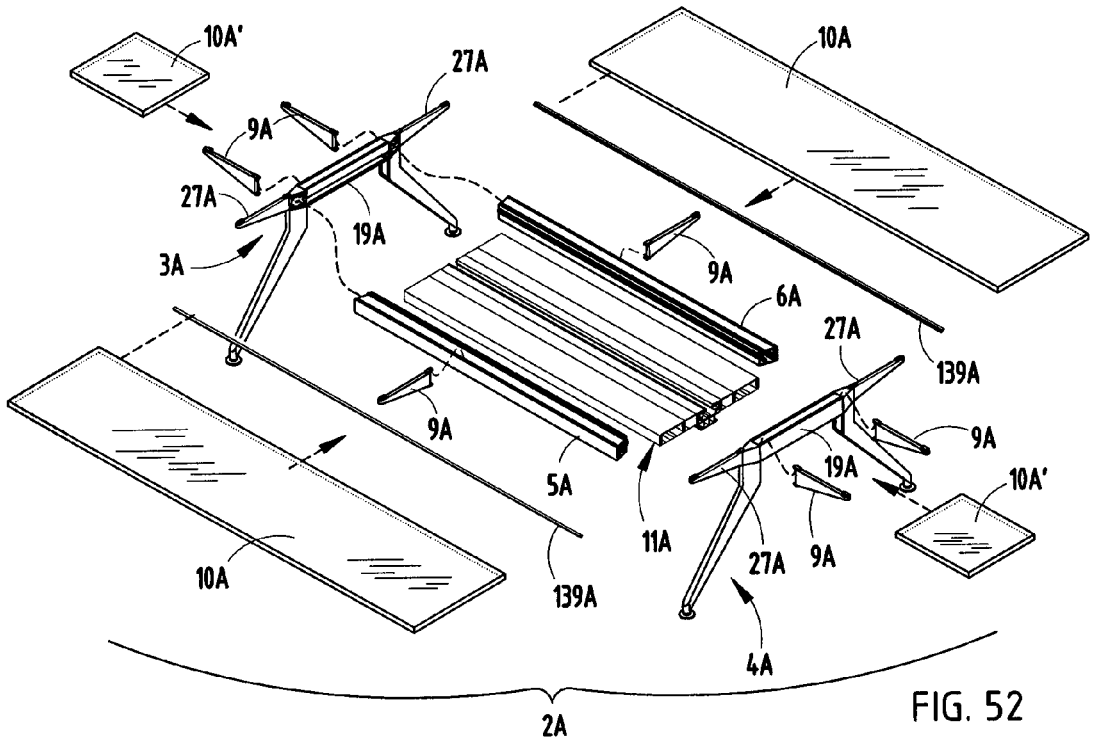
FIG. 52 is an exploded view of another embodiment of the present invention.
Figure 53:
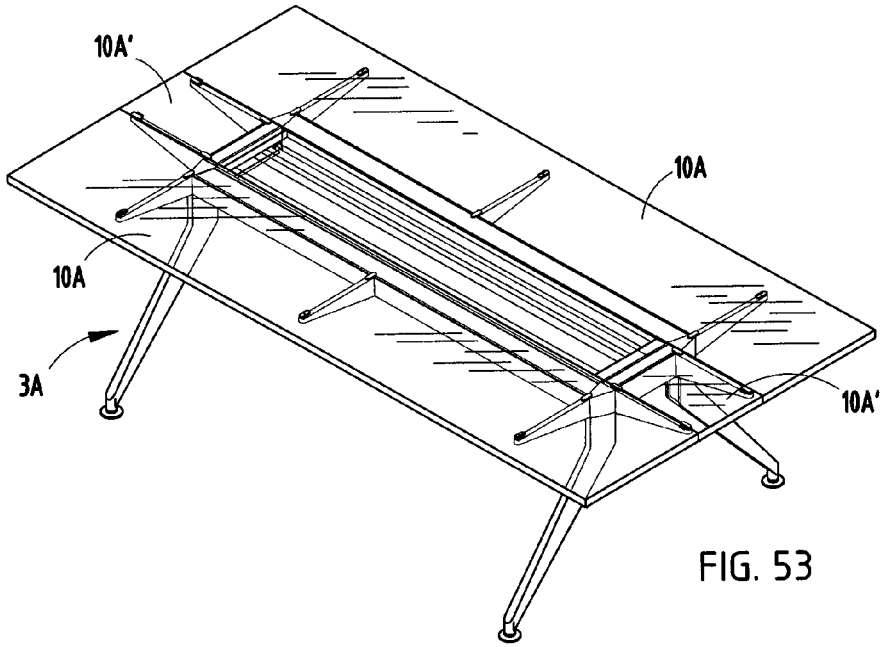
FIG. 53 is a perspective view of the table shown in FIG. 52.
Figure 54:
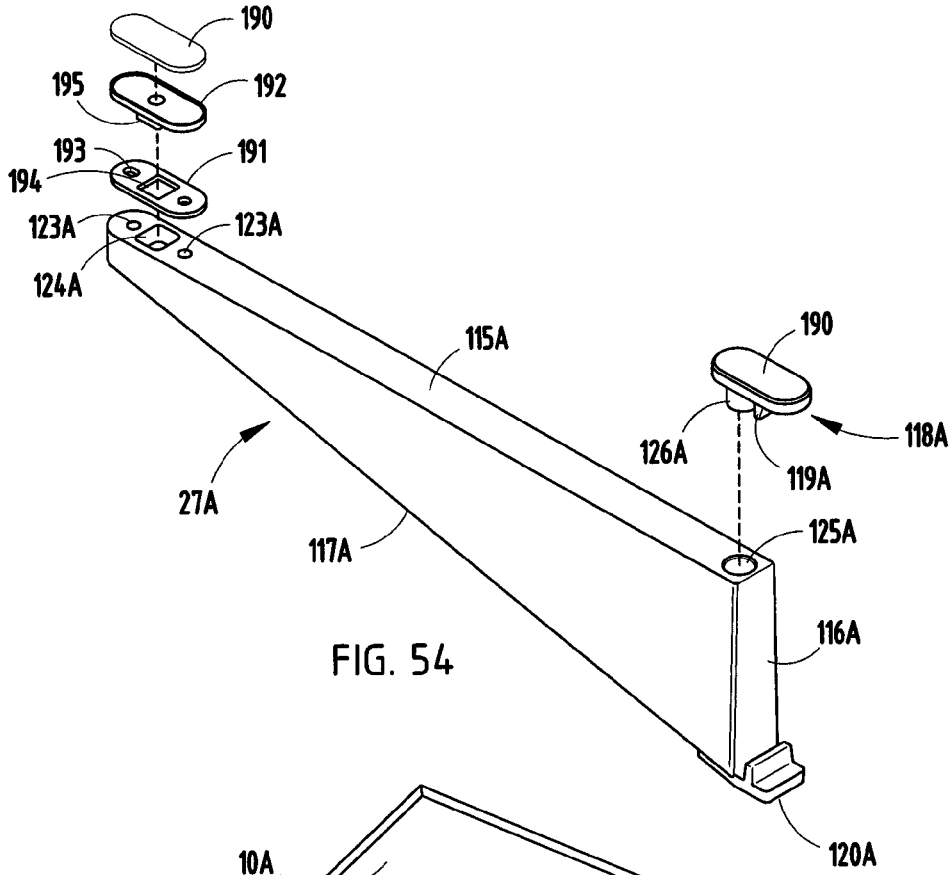
FIG. 54 is an exploded perspective view of the top support member shown in FIG. 54A.
Figure 55:
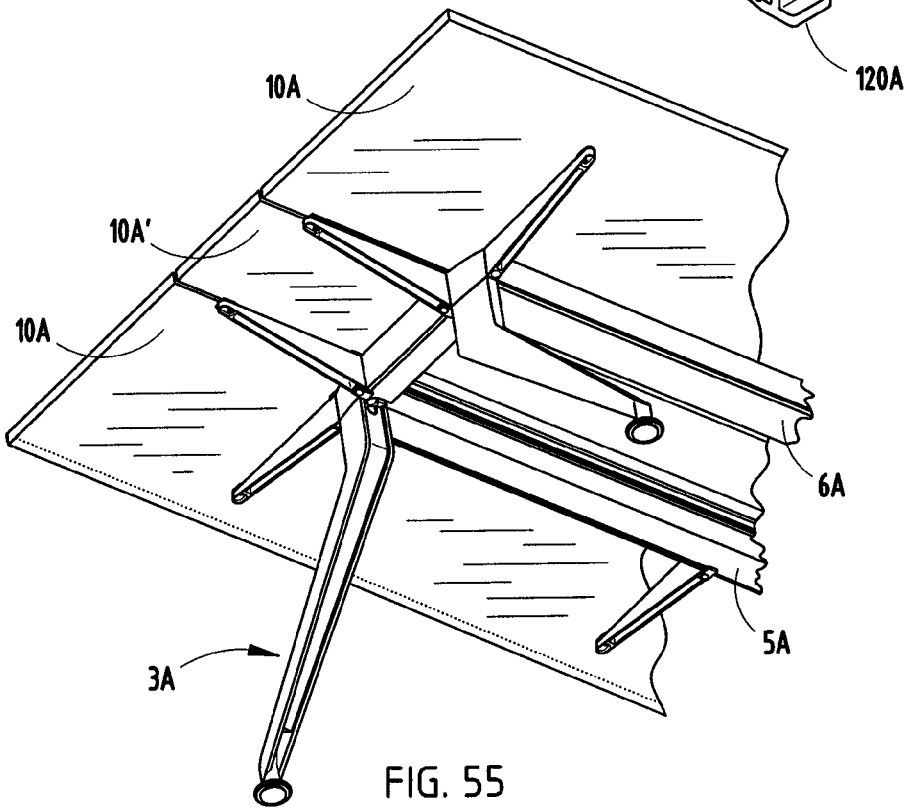
FIG. 55 is a fragmentary bottom perspective view of the table shown in FIGS. 52-54.
Figure 54A:
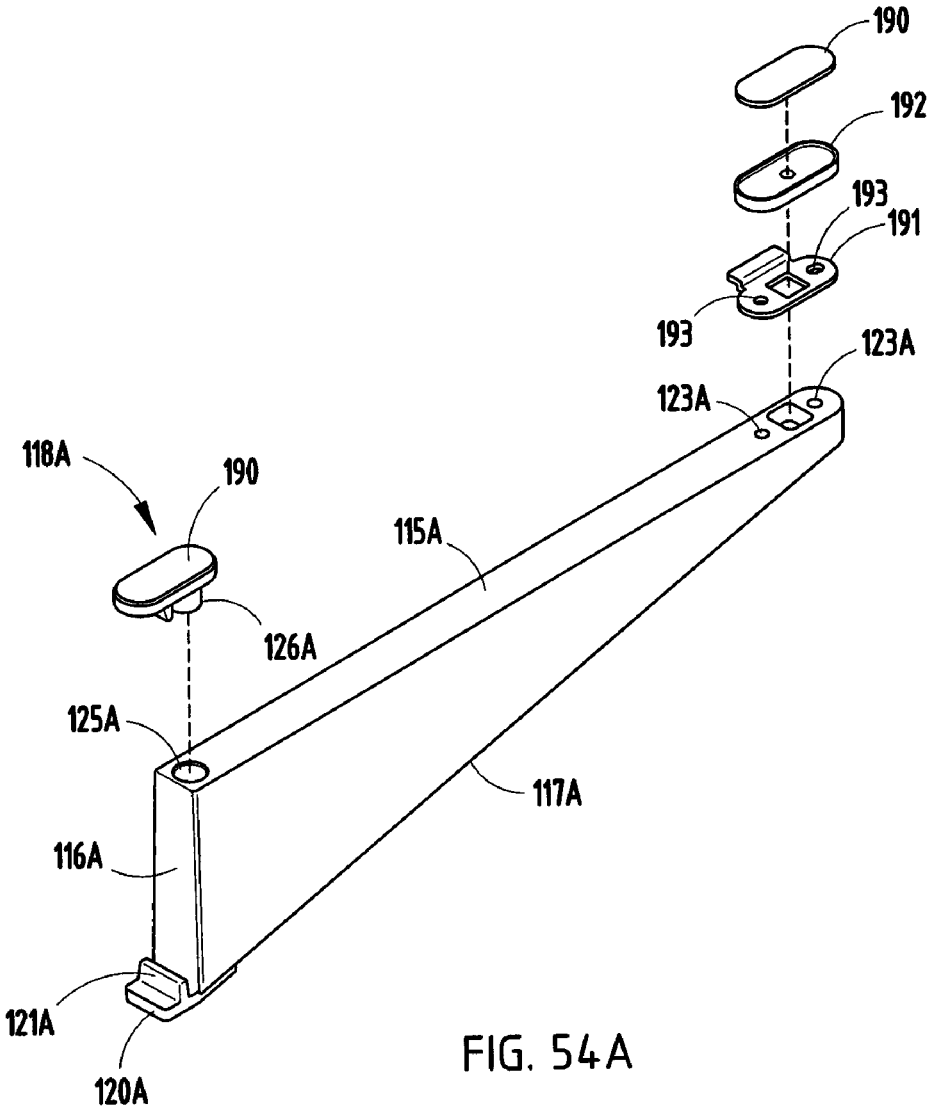
FIG. 54A is an exploded perspective view of a top support portion of the table shown in FIGS. 52 and 53.

FIGS. 52, 53 and 55 generally designate the glass top embodiment of the present invention 2A with similar parts appearing in FIGS. 1 and 2. In the example illustrated in FIG. 52, Z-shaped brackets 134A extending horizontally along the length of the top members 10. The bracket 134A is adhered to the bottom surface 131A of top member 10A by industrial adhesives known in the art and is designed to engage the channel 101A created by the flange 10A on the top wall 93A of side rail members 5A and 6A. FIGS. 53 and 55 designate the glass top table 2A fully assembled.

Figure 56:
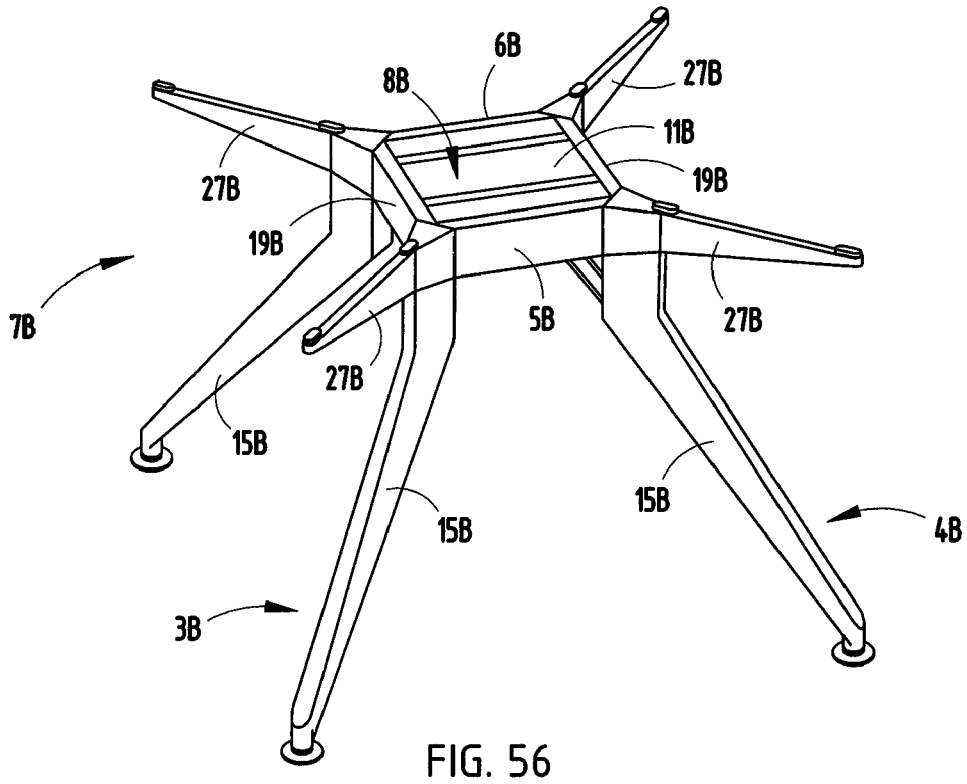
FIG. 56 is a perspective view of a table frame portion of another embodiment of the present invention.
Figure 57:
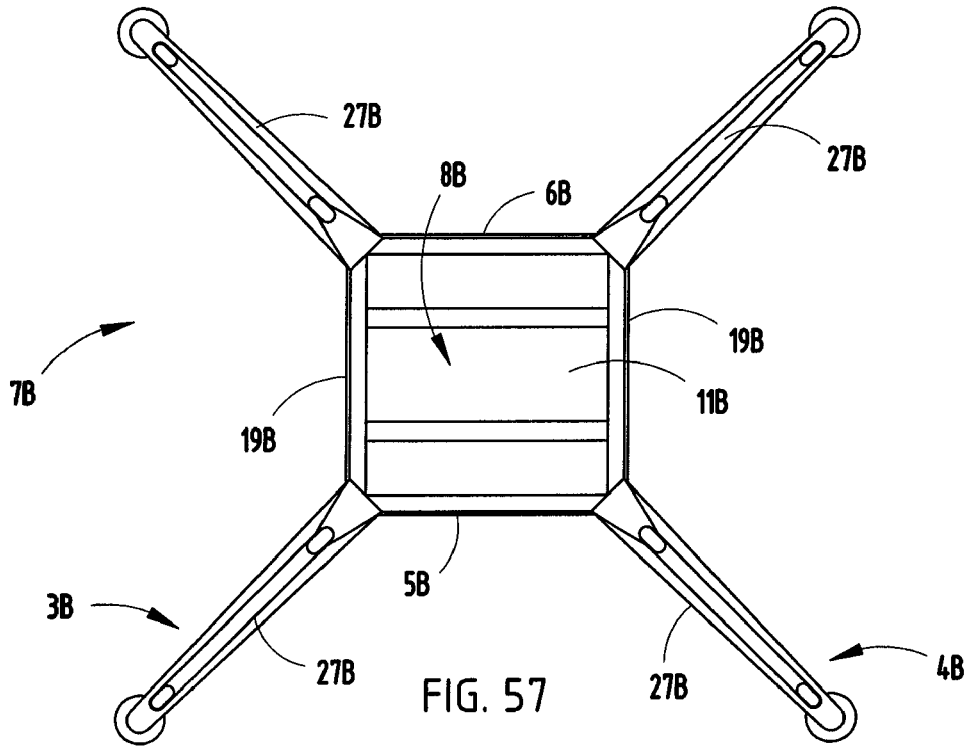
FIG. 57 is a top elevational view of the table frame shown in FIG. 56.
Figure 58:
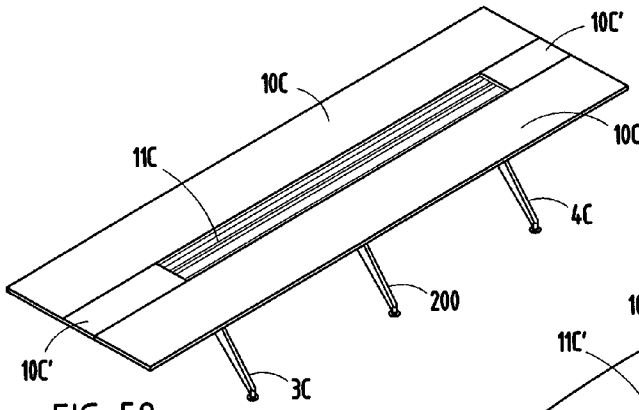
FIG. 58 is a perspective view of yet another embodiment of the present invention.

FIGS. 56 and 57 generally designate another embodiment of the present invention 2B with similar parts appearing in FIGS. 1, 2, 38 and 42, and are thus, represented by the same corresponding reference numerals except for the suffix "B" in the numerals of FIGS. 56 and 57. FIGS. 56 and 57 generally designate a table frame 7B for a glass, plastic or other transparent material top, as shown in FIG. 69, having end leg members 3B and 4B. In this embodiment of the present invention, side rail members 5B and 6B are approximately the same length as end rail members 19B. Thus, the table frame 7B has a generally square shaped window 8B for utility module member 11B to fit into. Also, in this embodiment, leg members 15B and top support arms 27B are angled out a approximately a 135 degree angle from end rail members 19B and side rail members 5B and 6B. The examples illustrated in FIGS. 56 and 57 can also be adapted to support top members made of wood or other like material as shown in FIG. 68.

Figure 59:
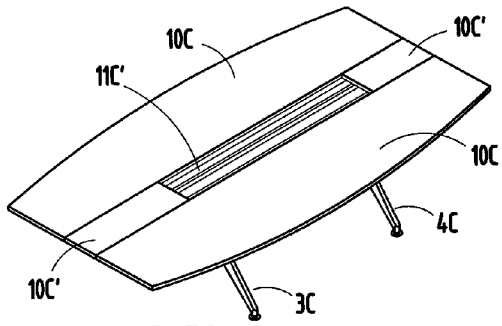
FIG. 59 is a perspective view of yet another embodiment of the present invention.
Figure 60:
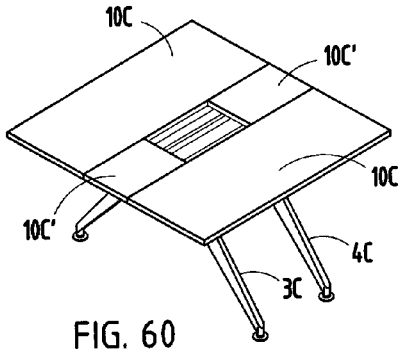
FIG. 60 is a perspective view of yet another embodiment of the present invention.
Figure 61:
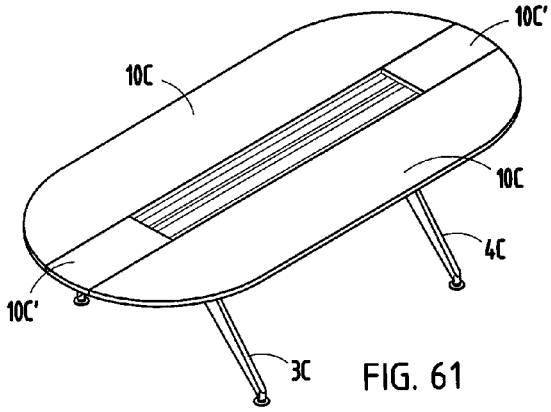
FIG. 61 is a perspective view of yet another embodiment of the present invention.
Figure 62:
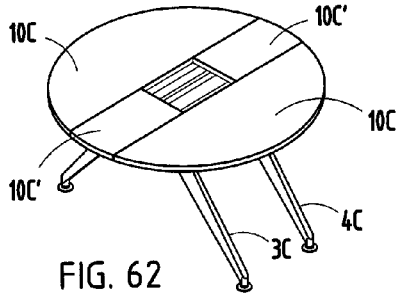
FIG. 62 is a perspective view of yet another embodiment of the present invention.
Figure 63:
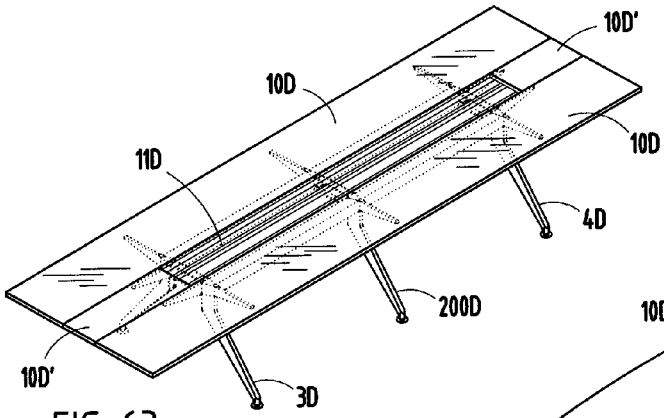
FIG. 63 is a perspective view of yet another embodiment of the present invention.

FIGS. 58-62 generally designate other embodiments of the present invention including solid top members 10 and 10' made of wood or like material and having similar parts as those designated in FIG. 2. Thus, similar parts appearing in FIG. 2 and FIGS. 58-62 respectively, are represented by the same, corresponding reference numerals, except for the suffix "C" in the numerals of the latter. Specifically, FIG. 58 designates an elongate table having a third intermediate leg member 200 disposed between end leg members 3C and 4C. In this embodiment, top members 10C and 10C' can be up to five meters long to support multiple workstations in one table construction 2C. FIG. 59 designates another embodiment of the present invention wherein top members 10C and 10C' have bowed exterior edges 133C to create a table of yet another configuration. FIG. 60 has top members 10C and 10C' which are shorter in length than those depicted in FIGS. 2 and 58 to create a table construction having a generally square shaped surface. FIG. 61 has top members 10C and 10C' with exterior edges 133C which are curved thus having a configuration of a generally oval shaped elongate table. FIG. 62 has top members 10C and 10C' with curved exterior edges 133C to designate a table construction having a generally circular worksurface.

Figure 64:
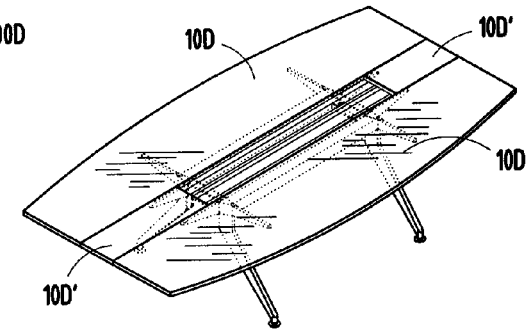
FIG. 64 is a perspective view of yet another embodiment of the present invention.
Figure 65:
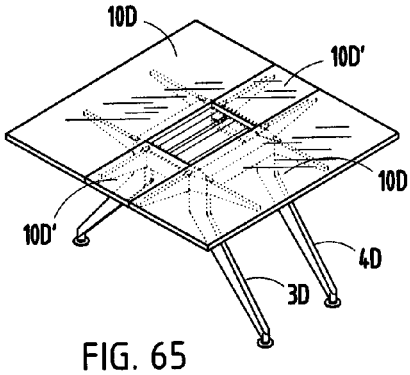
FIG. 65 is a perspective view of yet another embodiment of the present invention.
Figure 66:
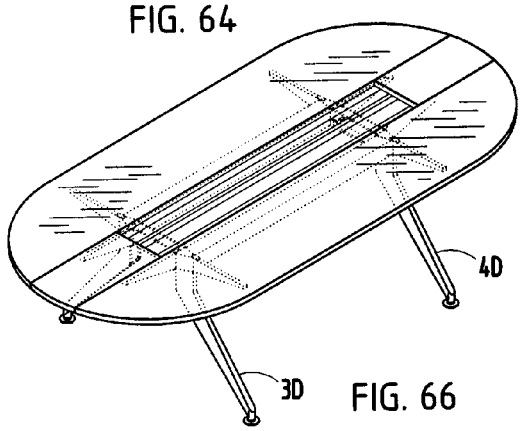
FIG. 66 is a perspective view of yet another embodiment of the present invention.
Figure 67:
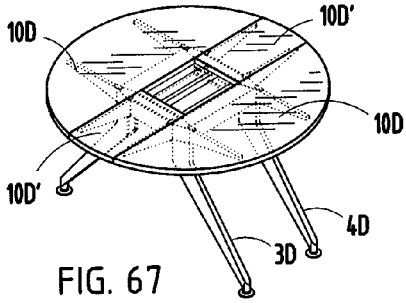
FIG. 67 is a perspective view of yet another embodiment of the present invention.

FIGS. 63-67 have similar parts found in FIGS. 58-62 and are thus represented by the same corresponding reference numerals except for the suffix "D" is used in the numerals of FIGS. 63-67. FIGS. 63-67 generally designate a table construction 2D having top members 10D and 10D' made of glass. Specifically, FIG. 63 designates an elongate table having a third intermediate leg member 200D disposed between end leg members 3D and 4D. In this embodiment, top members 10D and 10D' can be up to five meters long to support multiple workstations in one table construction 2C. FIG. 64 designates another embodiment of the present invention wherein top members 10D and 10D' have bowed exterior edges 133D to create a table of yet another configuration. FIG. 65 has top members 10D and 10D' which are shorter in length than those depicted in FIGS. 2 and 58 to create a table construction having a generally square shaped surface. FIG. 66 has top members 10D and 10D' with exterior edges 133D which are curved thus having a configuration of a generally oval shaped elongate table. FIG. 67 has top members 10D and 10D' with curved exterior edges 133D to designate a table construction having a generally circular worksurface.

Figure 68:
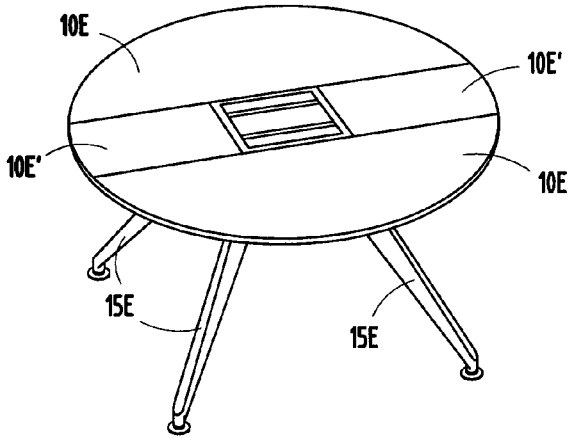
FIG. 68 is a perspective view of yet another embodiment of the present invention.
Figure 69:
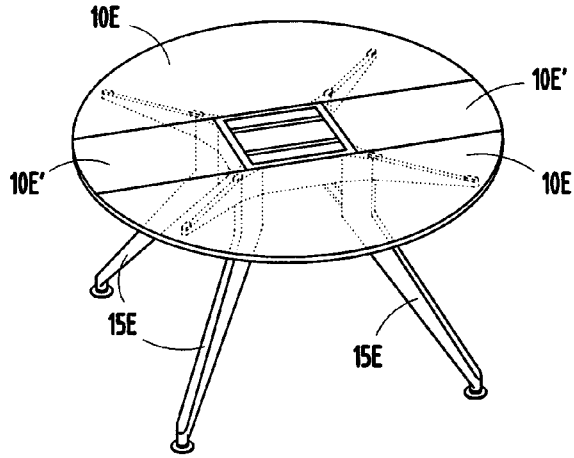
FIG. 69 is a perspective view of yet another embodiment of the present invention.

FIGS. 68 and 69 have similar parts found in FIGS. 3 and 58-62 and are thus represented by the same corresponding reference numerals except for the suffix "E" is used in the numerals of FIGS. 68 and 69. The example illustrated in FIG. 68 generally designates a table construction 2E with a top members 10E and 10E' made of wood or other like material supported by a table frame such as that illustrated in the examples of FIGS. 56 and 57. The example illustrated in FIG. 69 generally designates a table construction 2E with a top members 10E and 10E' made of glass, plastic or other like transparent material supported by a table frame such as that illustrated in the examples of FIGS. 56 and 57.

Figure 70:
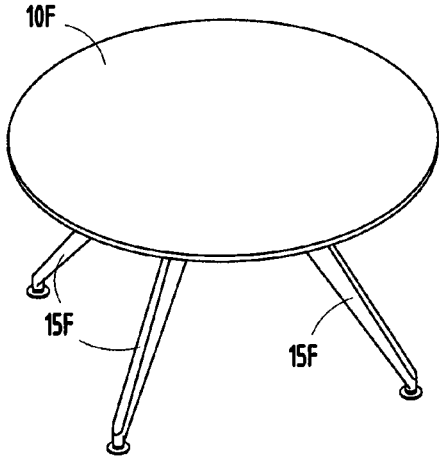
FIG. 70 is a perspective view of yet another embodiment of the present invention.
Figure 71:
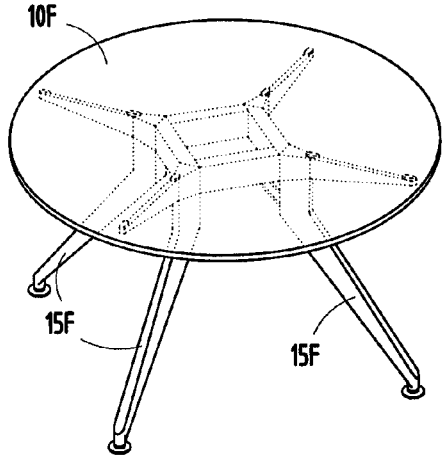
FIG. 71 is a perspective view of yet another embodiment of the present invention.

FIGS. 70 and 71 have similar parts found in FIGS. 3 and 58-62 and are thus represented by the same corresponding reference numerals except for the suffix "F" is used in the numerals of FIGS. 70 and 71. FIGS. 70 and 71 generally designate a table construction 2F having one piece top members 10F made of wood and glass, respectively, or other like material. Specifically, FIG. 70 generally designates a table construction 2F with a one piece top member 10F made of wood or other like material supported by a table frame such as that illustrated in the examples of FIGS. 56 and 57. The embodiment illustrated in FIG. 70 does not include a utility trough to make for a continuous worksurface made up of top member 10F. FIG. 71 generally designates a table construction 2F with a one piece top member 10F made of glass, plastic or other like material supported by a table frame as illustrated in the examples of FIGS. 56 and 57. The embodiment illustrated in FIG. 70 does not include a utility trough to make for a continuous worksurface made up of top member 10F.

Figure 72:
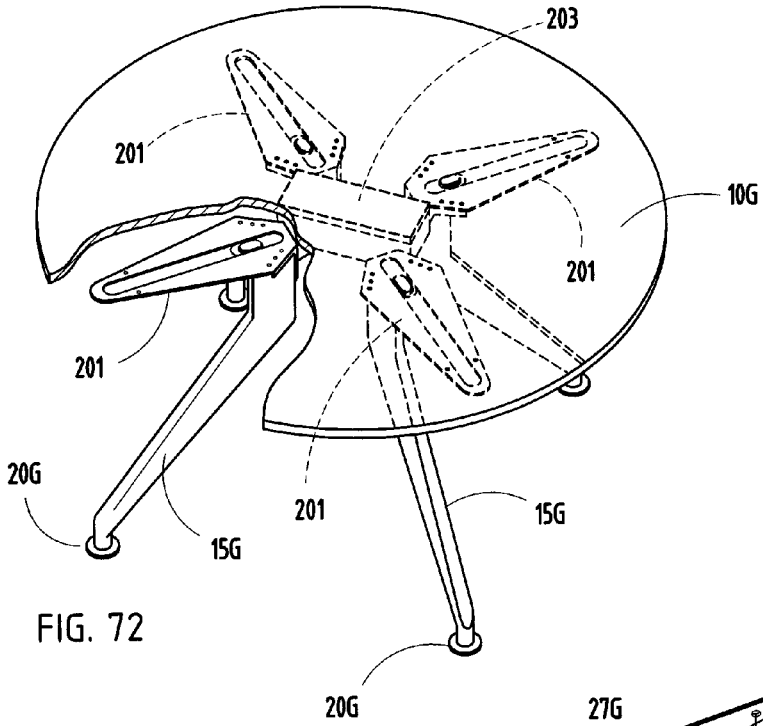
FIG. 72 is a perspective view of yet another embodiment of the present invention.
Figure 73:
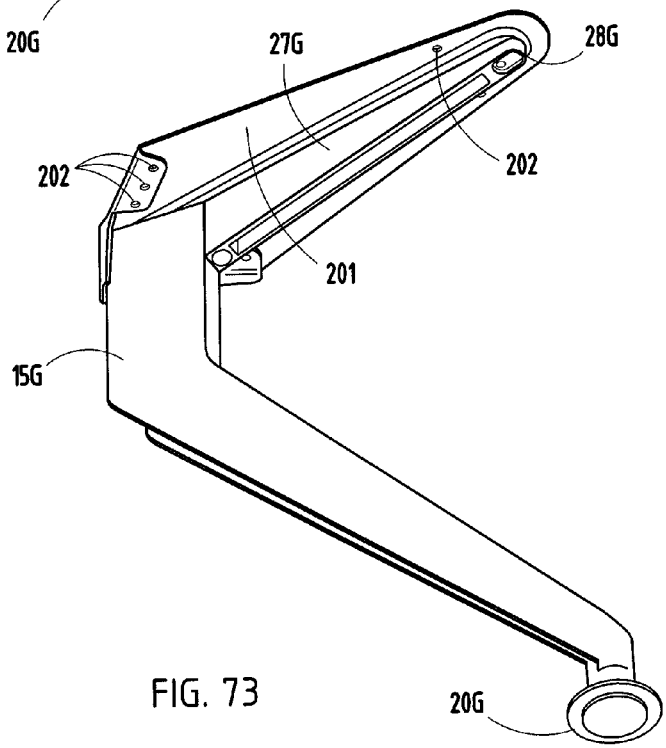
FIG. 73 is a perspective view of a leg used in another embodiment of the present invention.

The present invention may also be configured without a table frame whereby leg members are affixed directly to the top members as shown in the example illustrated in FIG. 72. FIGS. 72 and 73 have similar parts found in FIGS. 8, 11, 56-57, and 70, and are thus represented by the same corresponding reference numerals except for the suffix "G" is used in the numerals of FIGS. 72 and 73. The example illustrated in FIG. 73 generally designates a leg member 15G connected to support arm 27G. A plate 201 is connected to the support arm 27G at the outer portion 28G of support arm 27G at apertures 31G (not shown). Plate 201 also connects to the interior facing wall 38G (not shown) of the three way connector block 18G (not shown). Plate 201 is used to connect freestanding leg members 15G, which are connected to support arms 27G, to the top member 10G with fasteners (not shown) through apertures 202 disposed on plate 201. FIG. 72 generally designates a table construction 2G made up of freestanding leg members 15G connected directly to the top member 15G at plates 201. The table construction 2G may also include an optional power box 203 disposed in the center of top member 10G and attached directly thereto as shown in FIG. 72.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A table for offices and the like, comprising:

first and second end leg members disposed in a generally parallel, laterally spaced apart relationship, and configured to be abuttingly supported on a floor surface in a generally upright orientation;

first and second side rail members disposed in a generally parallel, laterally spaced apart relationship, and having opposite end portions thereof operably connected with upper portions of said first and second end leg members to rigidly retain said first and second end leg members in said generally upright orientation, and thereby define a rigid, self-supported table frame without intermediate bracing between first and second side rail members, with a central, vertically extending window, wherein said first and second side rail members include along outer portions thereof a first, upwardly opening channel extending along a top portion thereof and a second, downwardly opening channel extending along a bottom portion thereof;

a plurality of top support members operably connected with said first and second side rail members, and protruding outwardly therefrom in a cantilevered fashion, wherein said top support members include first and second tabs received and retained in said first and second channels on said first and second side rail members;

a top member supported on and operably connected with at least one of said table frame and said top support members to define a plurality of workstations along said table; and a utility module member configured to facilitate routing utilities to said workstations, positioned within said window of said frame and having opposite sides thereof abuttingly supported on said first and second side rail members to removably mount said utility module member on said frame and thereby accommodate a variety of different utility requirements at said workstations.

2. A table as set forth in claim 1, wherein:

said utility module member includes at least one trough member spanning between inside portions of said first and second side rail members, and including a raceway extending longitudinally therealong.

3. A table as set forth in claim 1, wherein:

said first and second side rail members include inwardly protruding ledges extending along inside portions thereof which abuttingly and removably support thereon said side portions of said trough member.

4. A table as set forth in claim 1, wherein:

said trough member includes at least one upwardly opening channel configured to detachably mount a variety of accessories therein to personalize said workstations.

5. A table as set forth in claim 1, wherein:

said top member includes a plurality of panels with interior edge portions disposed along said window in said frame.

6. A table as set forth in claim 1, including:

at least one removable fastener connected with said trough member and positively, yet detachably, retaining said trough member in position on first and second side rail members.

7. A table as set forth in claim 1, including:

at least one power module received and retained in said trough member.

8. A table as set forth in claim 1, including:

at least one communications module received and retained in said trough member.

9. A table as set forth in claim 1, wherein:

said top support member is connected with and extend outwardly from outside portions of said first and second side rail members.

10. A table as set forth in claim 1, wherein:

said top support members are detachably connected with outside portions of said first and second side rail members.

11. A table as set forth in claim 1, including:

a plurality of accessories having upper portions thereof configured to equip said workstations and lower portions thereof detachably mounted on said trough member.

12. A table as set forth in claim 1, wherein:

said trough member has a one-piece, hollow, box-like construction.

13. A table as set forth in claim 1, wherein:

said window of said frame has an elongate plan configuration; and said module member comprises a plurality of similarly shaped module members having different utility configurations and being detachably supported on said first and second side rail members in an end-to-end relationship to facilitate readily rearranging said utility module members on said table to accommodate a variety of different utility requirements at said workstations.

14. A table for offices and the like, comprising:

first and second end leg members disposed in a laterally spaced apart relationship, and configured to be abuttingly supported on a floor surface;

first and second side rail members disposed in a laterally spaced apart relationship, and having opposite end portions thereof operably connected with said first and second end leg members to define a table frame; said first and second side rail members each including an inwardly protruding ledge extending along an inside portion thereof, wherein said first and second side rail members include along said outer portions thereof a first, upwardly opening channel extending along a top portion thereof and a second, downwardly opening channel extending along a bottom portion thereof; and including;

a top member supported on and operably connected with said table frame;

a plurality of top support members having first and second tabs received and retained in said first and second channels on said first and second side rail members to detachably mount said top support member thereon; and a trough member positioned between said first and second side rail members and having opposite sides thereof abuttingly supported on said inwardly protruding ledges of said first and second side rail members to removably support said trough member on said table to accommodate different users.

15. A table as set forth in claim 14, wherein:

said trough member spans between said inside portion of said first and second side rail members, and is positively captured therebetween.

16. A table as set forth in claim 14, wherein:

said ledges include angled flanges which extend downwardly and inwardly along said inside portion of said first and second rail members.

17. A table as set forth in claim 14, wherein:

said trough member includes upstanding sidewalls with angled edge portions which wedgingly mate with said ledges of said first and second rail members to laterally capture said trough member in said window of said frame.

18. A table as set forth in claim 14, including:

a plurality of fasteners mounted in said trough member, and positioned to abuttingly engage an adjacent portion of said first and second side rail members to vertically capture said trough member in said window of said frame.

19. A table as set forth in claim 14, wherein:

said trough member includes at least one upwardly opening channel configured to detachably mount a variety of accessories therein to personalize work areas along said top member.

20. A table as set forth in claim 14, wherein:

said first and second side rail members have a generally hollow interior, and include at least one alignment channel extending along the interior portion thereof to facilitate attachment of said opposite end portions thereof to said first and second end leg members.

21. In a table of the type having first and second end leg members disposed in a laterally spaced apart relationship, and first and second side rail members disposed in a laterally spaced apart relationship with opposite end portions thereof operably connected with said first and second end leg members to define a rigid table frame supporting a top member thereon, the improvement of a modular leg assembly which defines at least one of said first and second end leg members, comprising:

first and second leg members each having an upper portion thereof and a lower portion thereof configured for abutting support on an associated floor surface;

an end rail member having opposite ends thereof operably connected with said first and second leg members to retain the same in a laterally spaced apart relationship; and first and second top support arms having outer portions thereof configured to support said top member thereon, and inner portions thereof having three-way connector blocks with first connectors extending generally downwardly from said table frame and detachably connected with said upper portions of said first and second leg members, second connectors extending generally inwardly from said table frame and detachably connected with said opposite ends of said first and second side rail members and third connectors extending generally laterally in relation to said table frame at a predetermined angle to said first and second connectors and detachably connected with said opposite ends of said end rail.

22. A table as set forth in claim 21, wherein:

said first and second leg members have a substantially identical shape, size and construction, such that the same are interchangeable.

23. A table as set forth in claim 21, wherein:

said first and second leg members include an interior raceway extending longitudinally therealong to facilitate routing wires therethrough.

24. A table as set forth in claim 23, wherein:

said end rail member includes an interior raceway therein which communicates with said raceways in said first and second leg members.

25. A table as set forth in claim 21, including:

first and second spacers connected with said connector blocks, and including outwardly extending tabs which engage said opposite ends of said first and second side rail members to positively align the same with said first and second end leg members.

26. A table as set forth in claim 21, including:

at least one cover enclosing an exterior portion of an associated one of said connector blocks.

27. A table as set forth in claim 21, including:

at least one trough member supported on said first and second side rail members, and including a raceway extending longitudinally therealong.

28. A table as set forth in claim 21, including:

at least one power module disposed adjacent to said top member.

29. A table for offices and the like, comprising:

first and second end leg members disposed in a laterally spaced apart relationship, and configured to be abuttingly supported on a floor surface;

first and second side rail members disposed in a laterally spaced apart relationship and having opposite end portions thereof operably connected with said first and second end leg members to define a table frame; said first and second side rail members each including an outwardly opening channel extending along a top portion thereof; and a top member supported on said table, and having an inwardly protruding tab with respect to said table disposed along an interior edge thereof, and closely received in said channel to removably connect at least a portion of said top member with said table frame.

30. A table as set forth in claim 29, including:

a plurality of top support members operably connected with said first and second side rail members along said outside portions thereof, and protruding outwardly therefrom in a cantilevered fashion; and a plurality of connectors connecting said top member with said top support members and positively retaining said tab in said channel.

31. A table as set forth in claim 30, wherein:

said tab is generally hook-shaped, and disposed along an interior edge of said top member.

32. A table as set forth in claim 31, wherein:

said connectors are positioned adjacent a medial portion of said top member.

33. A table as set forth in claim 32, wherein:

said top member includes a plurality of panels with interior edges thereof disposed along said first and second side rail members.

34. A table as set forth in claim 29, wherein:

said tab is generally hook-shaped, and disposed along an interior edge of said top member.

35. A table as set forth in claim 29, wherein:

said top member includes a plurality of panels with interior edges thereof disposed along said first and second side rail members.

36. A table for offices and the like, comprising:

first and second end leg members disposed in a generally parallel, laterally spaced apart relationship, and configured to be abuttingly supported on a floor surface in a generally upright orientation;

first and second side rail members disposed in a generally parallel, laterally spaced apart relationship, and having opposite end portions thereof operably connected with upper portions of said first and second end leg members to rigidly retain said first and second end leg members in said generally upright orientation, and thereby define a rigid, self-supported table frame without intermediate bracing between first and second side rail members, with a central, vertically extending window, wherein said first and second side rail members each include an outwardly opening channel extending along a top portion thereof adjacent inside portions of said first and second side rail members;

a plurality of top support members operably connected with said first and second side rail members, and protruding outwardly therefrom in a cantilevered fashion;

a top member supported on and operably connected with at least one of said table frame and said top support members to define a plurality of workstations along said table, wherein said top member includes an inwardly protruding tab disposed along an interior edge thereof, and closely received in said outwardly opening channel to removably connect at least a portion of said top member with said table frame; and a utility module member configured to facilitate routing utilities to said workstations, positioned within said window of said frame and having opposite sides thereof abuttingly supported on said first and second side rail members to removably mount said utility module member on said frame and thereby accommodate a variety of different utility requirements at said workstations.

37. A table for offices and the like, comprising:

first and second end leg members disposed in a laterally spaced apart relationship, and configured to be abuttingly supported on a floor surface;

first and second side rail members disposed in a laterally spaced apart relationship, and having opposite end portions thereof operably connected with said first and second end leg members to define a table frame; said first and second side rail members each including an inwardly protruding ledge extending along an inside portion thereof, wherein said first and second side rail members include an outwardly opening channel extending along a top portion thereof adjacent said inside portion of said first and second side rail members;

a top member supported on and operably connected with said table frame, wherein said top member includes an inwardly protruding tab disposed along an interior edge thereof, and closely received in said outwardly opening channel to removably connect at least a portion of said top member with said table frame; and a trough member positioned between said first and second side rail members and having opposite sides thereof abuttingly supported on said inwardly protruding ledges of said first and second side rail members to removably support said trough member on said table to accommodate different users.

* * * * *